US008242671B2

(12) United States Patent
Blondia et al.

(10) Patent No.: US 8,242,671 B2
(45) Date of Patent: Aug. 14, 2012

(54) METAL BODY ARC LAMP

(75) Inventors: Rudi Blondia, Fremont, CA (US); John Kiss, San Jose, CA (US); Douglas A. Doughty, Gilroy, CA (US)

(73) Assignee: Excelitas Technologies Singapore Pte, Ltd, Singapore (SG)

( * ) Notice: Subject to any disclaimer, the term of this patent is extended or adjusted under 35 U.S.C. 154(b) by 0 days.

(21) Appl. No.: 12/700,271

(22) Filed: Feb. 4, 2010

(65) Prior Publication Data

US 2010/0201244 A1 Aug. 12, 2010

Related U.S. Application Data

(62) Division of application No. 11/291,295, filed on Dec. 1, 2005, now Pat. No. 7,679,276.

(60) Provisional application No. 60/634,561, filed on Dec. 9, 2004.

(51) Int. Cl.
*H01J 1/00* (2006.01)

(52) U.S. Cl. ..... 313/113; 313/46

(58) Field of Classification Search ..... 313/113, 313/252, 146, 151, 545, 552, 643, 42, 46; 445/25, 26, 44

See application file for complete search history.

(56) References Cited

U.S. PATENT DOCUMENTS

| | | | |
|---|---|---|---|
| 3,495,118 | A | 2/1970 | Richter |
| 3,684,908 | A | 8/1972 | Beese |
| 3,808,496 | A | 4/1974 | McRae et al. |
| 4,599,540 | A | 7/1986 | Roberts |
| 4,633,128 | A | 12/1986 | Roberts et al. |
| 4,658,179 | A | 4/1987 | Roberts |
| 4,702,716 | A | 10/1987 | Roberts |
| 4,785,216 | A | 11/1988 | Roberts et al. |
| 4,823,043 | A | 4/1989 | Roberts et al. |

(Continued)

FOREIGN PATENT DOCUMENTS

| | | | |
|---|---|---|---|
| GB | 2 290 132 | A | 12/1995 |

(Continued)

OTHER PUBLICATIONS

Office Action received for Japanese Patent Application No. 2007-545534, mailed on May 17, 2011, 6 pages (3 pages of English Translation and 3 pages of Office Action).

*Primary Examiner* — Anh Mai
*Assistant Examiner* — Elmito Breval
(74) *Attorney, Agent, or Firm* — Peter A. Nieves; Sheehan Phinney Bass + Green

(57) ABSTRACT

A short arc lamp comprises front and back subassemblies including mating weld rings, whereby the lamp can be assembled and sealed through welding of the weld rings. Each subassembly includes a number of self-aligning components to facilitate assembly and improve alignment accuracy. The metal body of the lamp can have a cooling projection portion, which can be received by a heat sink to remove heat from near the anode. A heat sink also can be formed as part of the metal body. The lamp reflector can be a drop-in reflector, or can be formed as part of the metal body through a process such as metal injection molding. A single strut can be used to position the cathode, which can be part of the sleeve or received by a portion of the sleeve. A trigger electrode can be used to simplify the power supply for the lamp.

5 Claims, 22 Drawing Sheets

U.S. PATENT DOCUMENTS

| | | | | |
|---|---|---|---|---|
| 4,940,922 | A | 7/1990 | Schuda et al. | |
| 5,399,931 | A | 3/1995 | Roberts | |
| 5,418,420 | A | 5/1995 | Roberts | |
| 5,561,338 | A | 10/1996 | Roberts et al. | |
| 5,672,931 | A | 9/1997 | Kiss et al. | |
| 5,721,465 | A | 2/1998 | Roberts | |
| 5,961,203 | A | 10/1999 | Schuda | |
| 6,034,467 | A | 3/2000 | Roberts | |
| 6,114,807 | A | 9/2000 | Kavanagh | |
| 6,179,446 | B1 | 1/2001 | Sarmadi | |
| 6,181,053 | B1 | 1/2001 | Roberts | |
| 6,181,077 | B1 | 1/2001 | Greenland | |
| 6,200,005 | B1 | 3/2001 | Roberts et al. | |
| 6,274,970 | B1 | 8/2001 | Capobianco | |
| 6,285,131 | B1 | 9/2001 | Kiss et al. | |
| 6,297,591 | B1 | 10/2001 | Roberts | |
| 6,316,867 | B1 | 11/2001 | Roberts et al. | |
| 6,316,877 | B1 | 11/2001 | Kaas | |
| 6,339,279 | B1 | 1/2002 | Miyamoto et al. | |
| 6,351,058 | B1 | 2/2002 | Roberts | |
| 6,376,993 | B1 | 4/2002 | Romanczuk et al. | |
| 6,400,067 | B1 | 6/2002 | Manning et al. | |
| 6,435,699 | B2 * | 8/2002 | Glowach et al. | 362/294 |
| 6,561,675 | B1 | 5/2003 | Kavanagh | |
| 6,597,087 | B2 | 7/2003 | Roberts et al. | |
| 7,301,262 | B1 * | 11/2007 | Roberts et al. | 313/46 |
| 2003/0086271 | A1 * | 5/2003 | Masuoka et al. | 362/345 |
| 2003/0090902 | A1 | 5/2003 | Kavanagh | |
| 2003/0193281 | A1 | 10/2003 | Manning | |

FOREIGN PATENT DOCUMENTS

| | | | |
|---|---|---|---|
| JP | 4-298994 | A | 10/1992 |
| JP | 7-507179 | A | 8/1995 |
| JP | 9-283090 | A | 10/1997 |
| SU | 519792 | | 7/1976 |
| WO | WO 93/26034 | | 12/1993 |
| WO | WO 98/31043 | | 7/1998 |

* cited by examiner

METAL BODY ARC LAMP

CLAIM OF PRIORITY

This divisional application claims priority to U.S. patent application Ser. No. 11/291,295, filed Dec. 1, 2005, which in turn claims priority to U.S. Provisional Patent Application No. 60/634,561, filed Dec. 9, 2004, both of which are hereby incorporated herein by reference.

TECHNICAL FIELD OF THE INVENTION

The present invention relates generally to light sources and particularly to arc lamps and methods of manufacturing such lamps.

BACKGROUND

Short arc lamps provide intense point sources of light for applications such as medical endoscopes, instrumentation, and video projection. Short arc lamps also are used in industrial endoscopes, such as in the inspection of jet engine interiors. More recent applications have included dental curing systems, as well as color television receiver and movie theater projection systems, such as is described in pending U.S. Provisional Patent Application No. 60/634,729, entitled "SHORT ARC LAMP LIGHT ENGINE FOR VIDEO PROJECTION," filed Dec. 9, 2004, hereby incorporated herein by reference. A typical short arc lamp comprises an anode and a sharp-tipped cathode positioned along the longitudinal axis of a cylindrical, sealed concave chamber in a ceramic reflector body that contains xenon gas pressurized to several atmospheres. Descriptions of such arc lamps can be found, for example, in U.S. Pat. Nos. 5,721,465, 6,181,053, and 6,316,867, each of which is hereby incorporated herein by reference. The manufacture of high power xenon arc lamps involves the use of expensive and exotic materials, as well as sophisticated fabrication, welding, and brazing procedures. Reduction in parts count, assembly steps and tooling requirements provides cost savings and improved product reliability and quality.

Exemplary prior art arc lamps are shown in FIGS. 1 and 2. The first lamp 100 comprises an optical coating 102 on a sapphire window 104, a window shell flange 106, a body sleeve 108, a pair of flanges 110 and 112, a three piece strut support assembly 114, a cathode 116, an alumina-ceramic elliptical reflector body 118, a metal shell or sleeve 120, a copper anode base 122, a base weld ring 124, a tungsten anode 126, a gas tabulation 128, and a charge of xenon gas 130. The second lamp 200 comprises a tilted hot minor assembly 201 including a retaining ring 202, a tilted collar 204, a color filter 206, a hot-mirror 208, and a ring housing 210. A tilted land 212 inside the ring housing 210 matches the orientation of the tilted collar 204. The lamp further includes a sapphire window 214 set in a ring frame 216. A single bar strut 218 attaches at opposite points on the bottom of the ring frame 216. A cathode 220 has a slotted end opposite to the pointed arc-discharge end. A body sleeve 222 has a xenon-fill tubulation 224 made of copper tubing. A xenon gas charge 226 is injected into the lamp 200 after final assembly. The lamp also includes a ceramic reflector 228, an anode flange 230, and a tungsten anode 232.

Problems with arc lamps such as these include the relatively large number of parts needed to manufacture the lamps, which increases manufacture time and cost. Also, it can be difficult to achieve the precision alignment needed for the arc gap dimensions to assure consistent lamp operation in these arc lamps. Additional tooling typically is used for alignment, which increases the time necessary for manufacture and increases the probability of damaging a lamp during manufacture.

Various attempts have been made to reduce the number of parts and improve the lifetimes and efficiencies of these lamps. Attempts were made to reduce the number of welds, such as by brazing pieces together, but the materials and brazing techniques available often did not provide the necessary strength for pressurized operation. The types of materials being used and processes for manufacturing components were varied, but often resulted in designs that could not meet the cost target of the intended applications, due to the high costs of materials such as ceramics. Further, components such as a heat conductive mounting that were fabricated from a ceramic material to facilitate high temperature operation had poor heat conduction properties and did not facilitate heat transfer from the enclosed atmosphere. This limit on the operating temperature placed a constraint on the power at which the lamps could be operated.

There also were many attempts to redesign the reflector in order to keep the reflector cool. A conventional reflector is electroformed, with a heat conductive mounting that is built up by electroplating, then machined to the proper size. Alternatively, the reflector can be brazed to a metal heat conductive mounting then machined. These steps require a significant amount of additional machining and cost. Another approach was to machine the reflector directly into the heat conductive mounting, using a machine such as a precision diamond tool lathe. The reflector then is coated with a material such as silver. This still required a significant amount of machining, and the lathe-produced reflector typically had grooves or surface roughness that did not produce an optical reflector.

Due to the increasingly large numbers of xenon arc lamps being produced and marketed, opportunities to save money on the materials, manufacturing, and/or assembly procedures are constantly being sought. Being the low-cost producer in a market typically translates into a strategic competitive advantage.

BRIEF DESCRIPTION OF THE DRAWINGS

FIG. 4(*b*) is a diagram of another back assembly with grooved sides that can be used in accordance with one embodiment of the present invention.

FIG. 4(*c*) is a cross-section of a back assembly with a flat back, in accordance with one embodiment of the present invention.

FIG. 6(*b*) is a cross-section diagram of a front assembly of an arc lamp in accordance with one embodiment of the present invention.

FIG. 13(*b*) is a cross-section diagram showing assembled front and back assemblies including front and rear heat sinks in accordance with one embodiment of the present invention.

DETAILED DESCRIPTION

Systems and methods in accordance with various embodiments of the present invention can overcome these and other deficiencies in existing short arc lamp assemblies. Arc lamps in accordance with these embodiments can have fewer parts, use less expensive materials, utilize simpler tooling, and require fewer assembly steps than existing short arc lamps. These arc lamps can provide for a better yield, with lower labor costs and optimized automation.

For discussion purposes, arc lamps in accordance with various embodiments of the present invention can be divided into a pair of sub-assemblies, which will be referred to herein as a "front" assembly and a "back" assembly. These lamps then can be constructed by joining the front and back assemblies. In one such arc lamp, an arc is struck between an anode of the back assembly and a cathode of the front assembly in an enclosed atmosphere, typically containing xenon gas. In other embodiments, the anode can be placed in the front assembly and the cathode in the back assembly. It should be understood when the electrodes are discussed herein that the anode and cathode electrodes could be reversed in different embodiments, and that the descriptions given are only meant to be exemplary. Ways of configuring electrodes in order to determine the flow of electrons across the arc gap are well known in the art and will not be discussed in detail herein. The lamp includes a window or other transmissive element for emitting the light generated therein, and typically uses a reflector opposite the window for reflecting light toward the window. A DC power supply can be used to apply a voltage across the gap between the anode and cathode as known in the art.

Figure 1:
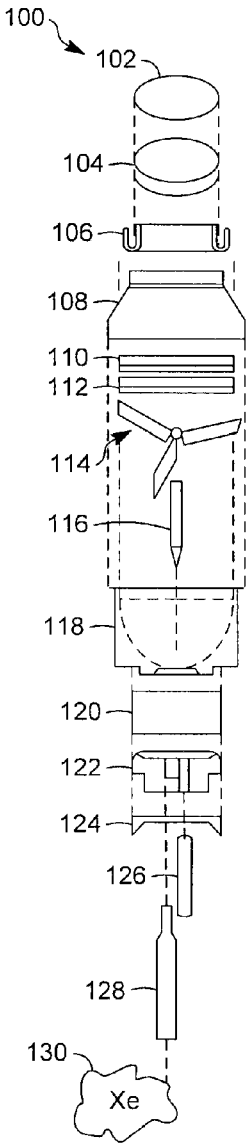
(PRIOR ART) FIG. 1
FIG. 1 is a diagram of a first short arc lamp assembly of the prior art.
Figure 2:
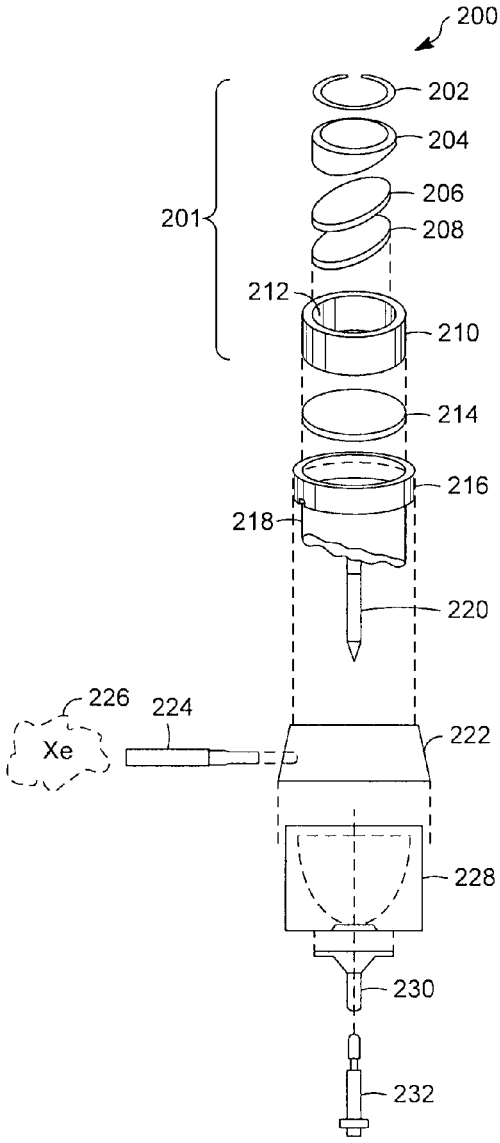
(PRIOR ART) FIG. 2
FIG. 2 is a diagram of a second short arc lamp assembly of the prior art.
Figure 3A:
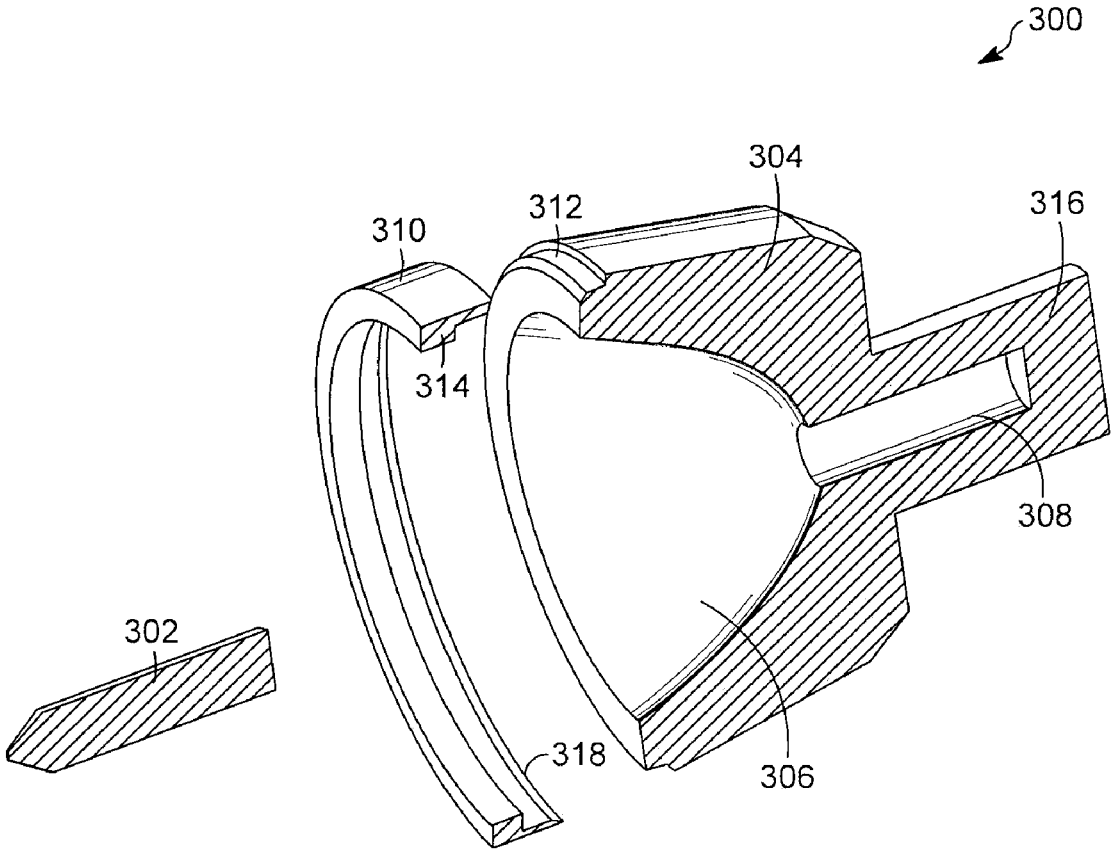
FIG. 3 is (a) a perspective view diagram and (b) a cross-section diagram of a back assembly of an arc lamp in accordance with one embodiment of the present invention.
Figure 3B:
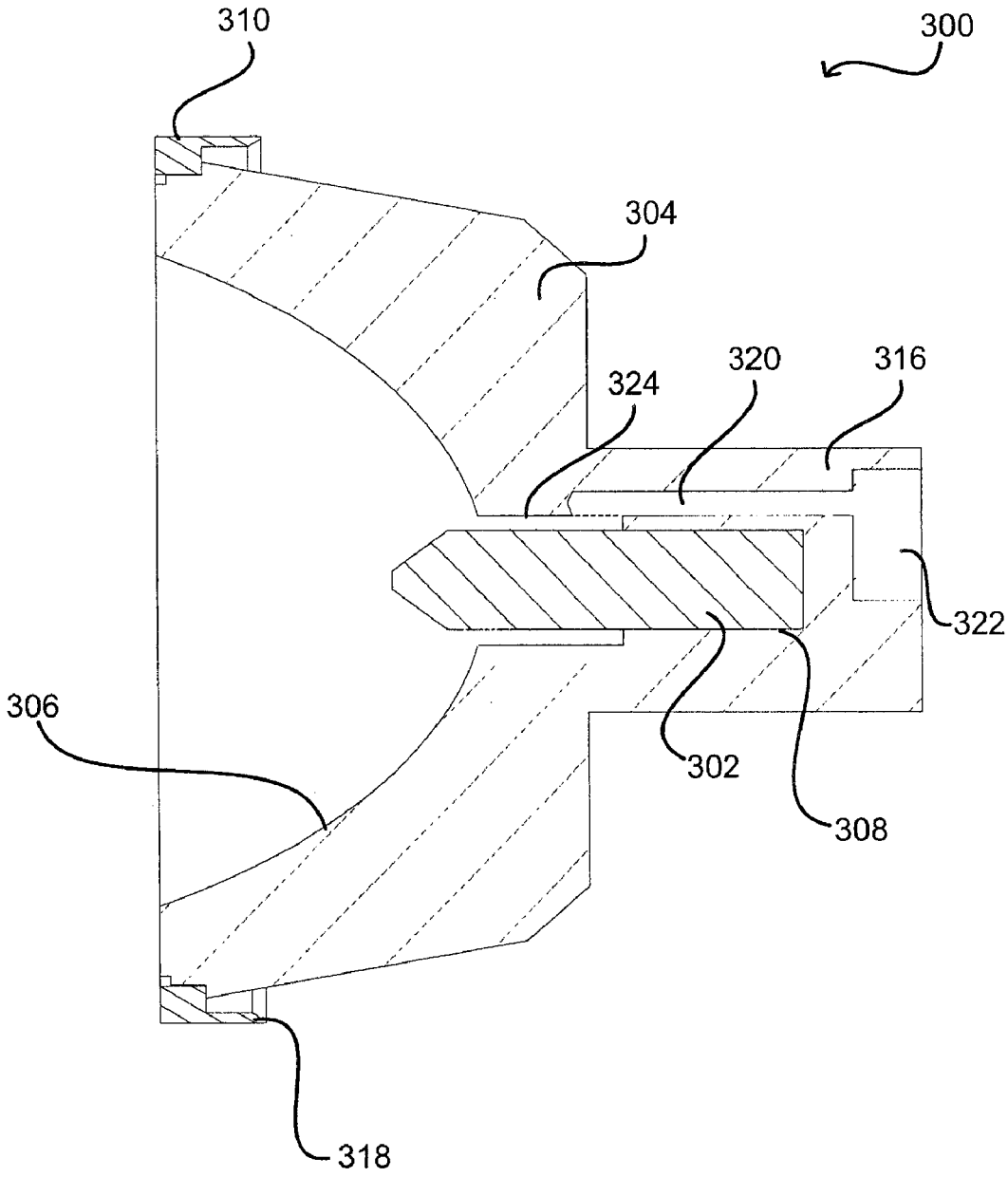

An exemplary back assembly 300 is shown in FIGS. 3(*a*) and 3(*b*). The back assembly has a base 304 that can be made of an appropriate metal, such as copper or a copper alloy, which can be easier to shape and machine than a ceramic, and can allow the lamp to run at a lower temperature by improving heat transfer and removal. This lower operating temperature can prolong the lifetime of the lamp. The metal body can be made using any appropriate fabrication method, such as by machining or milling the body from a metal cylinder or block. The metal body 304 can have a reflector cavity 306 formed in a first end. The cavity can have a shape similar to that of the desired reflector, such as a spherical, parabolic, or elliptical shape. The surface finish of the cavity can be determined in part by the reflector to be used. For example, the cavity 306 can be formed with a sufficient finish that the metal cavity acts as the reflector, wherein the metal reflector cavity also can be coated with an appropriate reflecting material. An advantage of a metal reflector over a ceramic reflector is that the metal does not have to be glazed before being coated. Appropriate coating materials capable of withstanding the heat at which the arc lamp operates are known in the art, and can include reflecting materials such as silver and dichroic materials, including thin layers of metallic oxides, such as titanium oxide and silicon oxide. A dichroic coating can improve the performance of the reflector by absorbing unwanted or unutilized radiation, such as radiation in the infrared and/or ultraviolet bands, whereby the reflected light does not contain as much heat. In order to obtain the appropriate surface finish, the cavity 306 of the metal body 304 can be diamond turned. In another approach, the metal body can be formed by a MIM (metal injection molding) process using a fine particle size that does not require subsequent machining. Metal injection molding typically utilizes metal particles mixed into a binder. This mixture then can be forced into a mold having the approximate dimensions of the desired part. The molded material then can be removed from the mold, and can be fired at high temperature in order to sinter the metal particles together and remove any residual binder material. This process allows for the economical incorporation of complex features in a part, as separate machining steps are not required to form these features.

The metal body 304 can have a projection portion 316, or cooling cylinder, at an end opposite the first end. The cooling cylinder in one embodiment has a length of about 0.75 inches and a diameter of about 0.5 inches, the diameter being about twice the diameter of the anode 302. The diameter of the cooling cylinder can be at least 33% of the diameter of the metal body, but less than the diameter of the metal body, such as a diameter that is less than 67% of the diameter of the metal body. The cooling cylinder 316 can include a blind hole 308 for receiving the anode 302. The blind hole can serve as a stop and allow for an easy but precise placement of the anode relative to a central axis of the reflector 306, and can help to position the anode at a proper depth relative to the position of the cathode upon assembly. This can help to minimize the amount of tooling needed to seat the anode. For example, in one embodiment the blind hole has a depth of 0.3 inches, which allows a 0.75-inch long anode to extend approximately 0.45 inches into the gaseous atmosphere. In this example, approximately 40% of the anode is in contact with the blind hole for heat transfer, and about 60% of the anode is exposed to the plasma in the arc lamp. The amount of anode contact with the blind hole in this embodiment can help to ensure that electromagnetic interference generated by the lamp is not present at nominal operating powers. The use of a blind hole instead of a through hole eliminates an evacuation path from the gas interior to the outside environment, such that it is not necessary to seal the hole. The cooling cylinder 316 can have a smaller diameter than the bulk of the metal body 304, allowing a heat sink (not shown) to be attached directly to the metal body near the anode 302. The diameter of the cooling cylinder 316 can be larger than projecting features found in existing lamps, in order to provide a surface area capable of sufficiently conducting heat away from the lamp. The projection also can lessen the distance between the exterior of the metal body 304 and the anode 302, which improves the removal of heat from the anode. This can be important, as most of the heat generated by the arc can be conducted away by the anode during operation.

Due to the high operating temperatures, tungsten often is used for the anode and cathode electrodes. Tungsten can still erode at high power operation, however, and does not provide the amount of thermal conductivity of other materials such as copper. As such, it can be desirable to utilize electrodes that are not made of a single material, but might have regions of different materials. In one embodiment, a tungsten pill is used in a copper anode. The copper provides beneficial thermal conduction for cooling, and the tungsten provides the desired heat resistance. It can be desirable to form the blind hole 308 of a diameter that is large enough to allow the anode 302 to easily be positioned into the blind hole, but small enough that heat can be transferred from the anode into the sides of the blind hole 308. The anode can be brazed into the blind hole with the braze material filling the voids between the body and the electrode, thus ensuring adequate thermal contact therebetween.

In order to facilitate the assembly of the front and back subassemblies, a weld ring 310 can be attached to the first end of the metal body 304. The weld ring can be attached to the metal body by any appropriate attachment process, such as by brazing. Brazing is a process well known in the art and will not be discussed in detail herein. In order to facilitate assembly and to ensure the proper placement of the weld ring 310 relative to the metal body 304, the weld ring can be made to be self-jigging. Particularly, the weld ring 310 can have a lip region 314 that is formed to mate with a recess region 312 of the metal body 304. The weld ring can have a knife edge 318 on one end to facilitate welding of the ring to a mating weld ring as discussed below. The weld ring can have approximate dimensions in one embodiment of 1.7 inches in diameter by 0.2 inches in length. The weld ring can be made of any appropriate material, such as a nickel alloy.

FIG. 3(*b*) also shows an access hole 320 extending from the back of the metal body (here from the back of the cooling cylinder 316) to the side of the blind hole 308. The access hole 320 can be used for filling of the lamp assembly with gas, such as through the use of a copper tube (not shown) that is brazed or otherwise connected into a recess 322 at the back of the body. The access hole 320 can extend up to a circular gap region 324 around the anode 302, where the blind hole 308 is not in direct contact with the anode. The gas passageway through the access hole can extend into the circular gap region 324 so that the interior of the lamp is accessible for pumping and filling. In this way, the lamp can be filled without having to extend the access hole 320 through to the reflector, thus preserving the reflector surface from a hole that could reduce the light collection capability of the reflector.

Figure 4A:
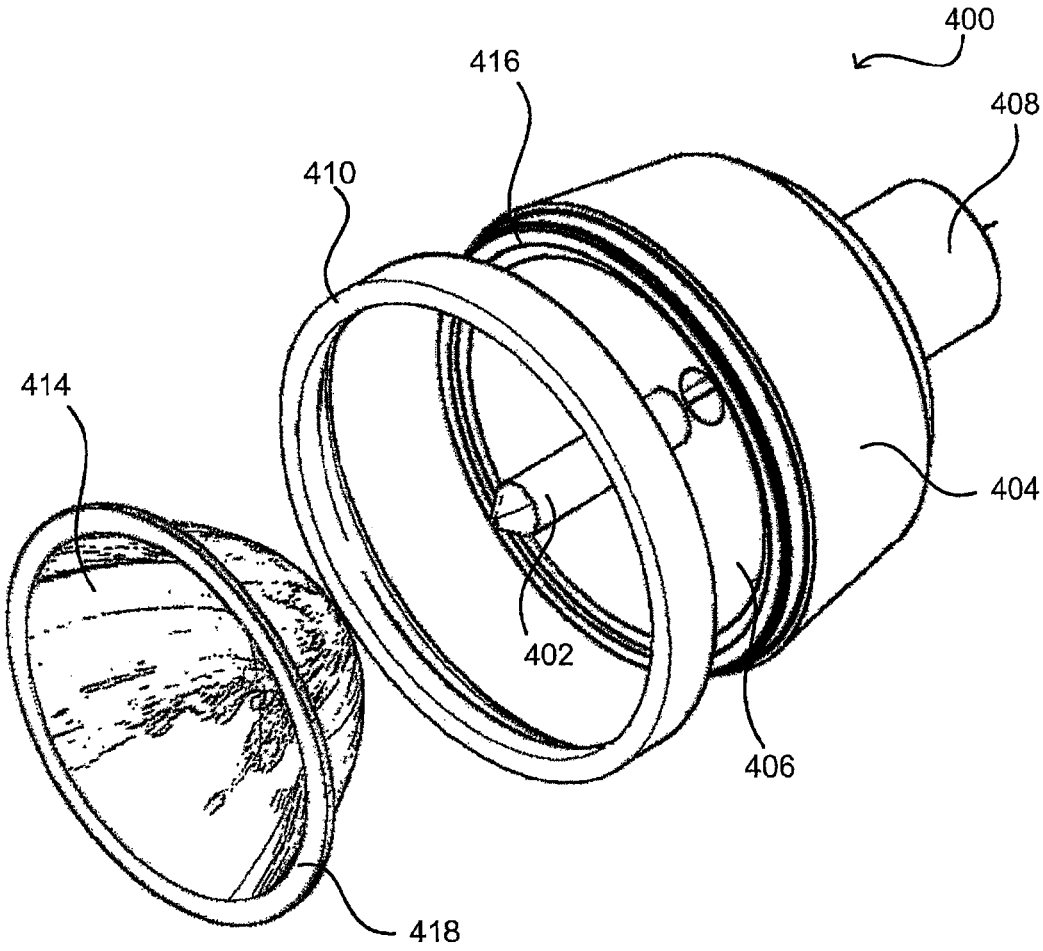
FIG. 4(*a*) is a diagram of a back assembly having a drop-in reflector in accordance with one embodiment of the present invention.
Figure 4B:
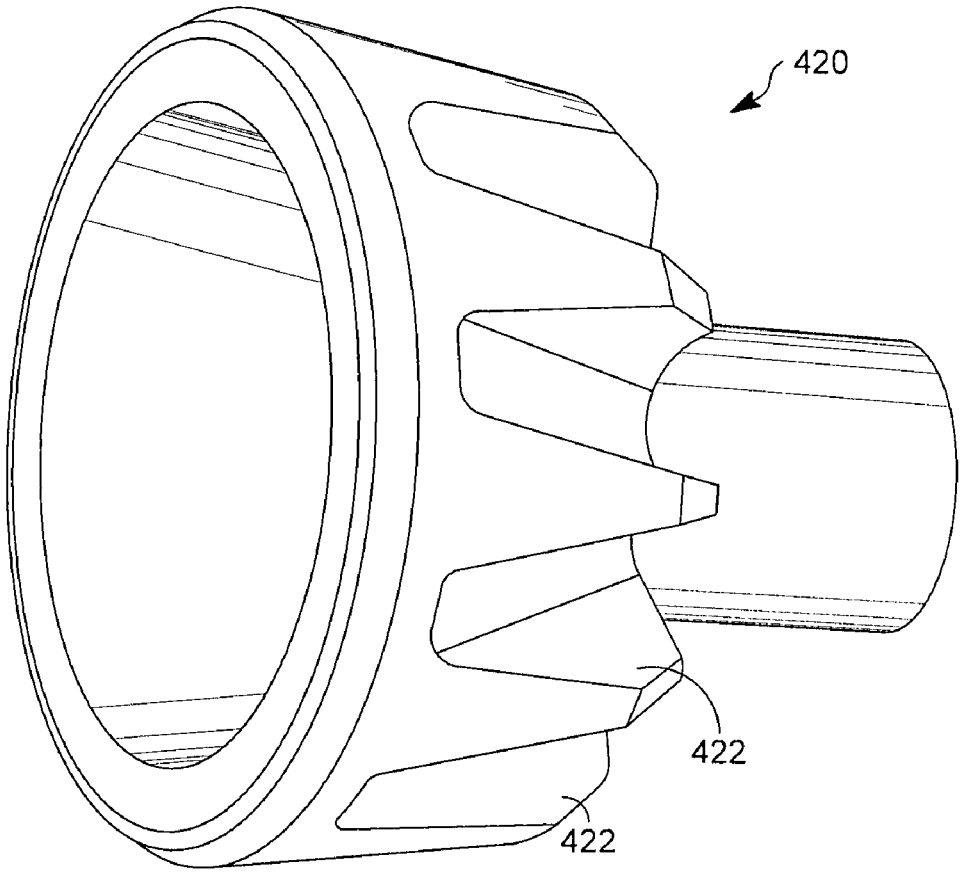
Figure 4C:
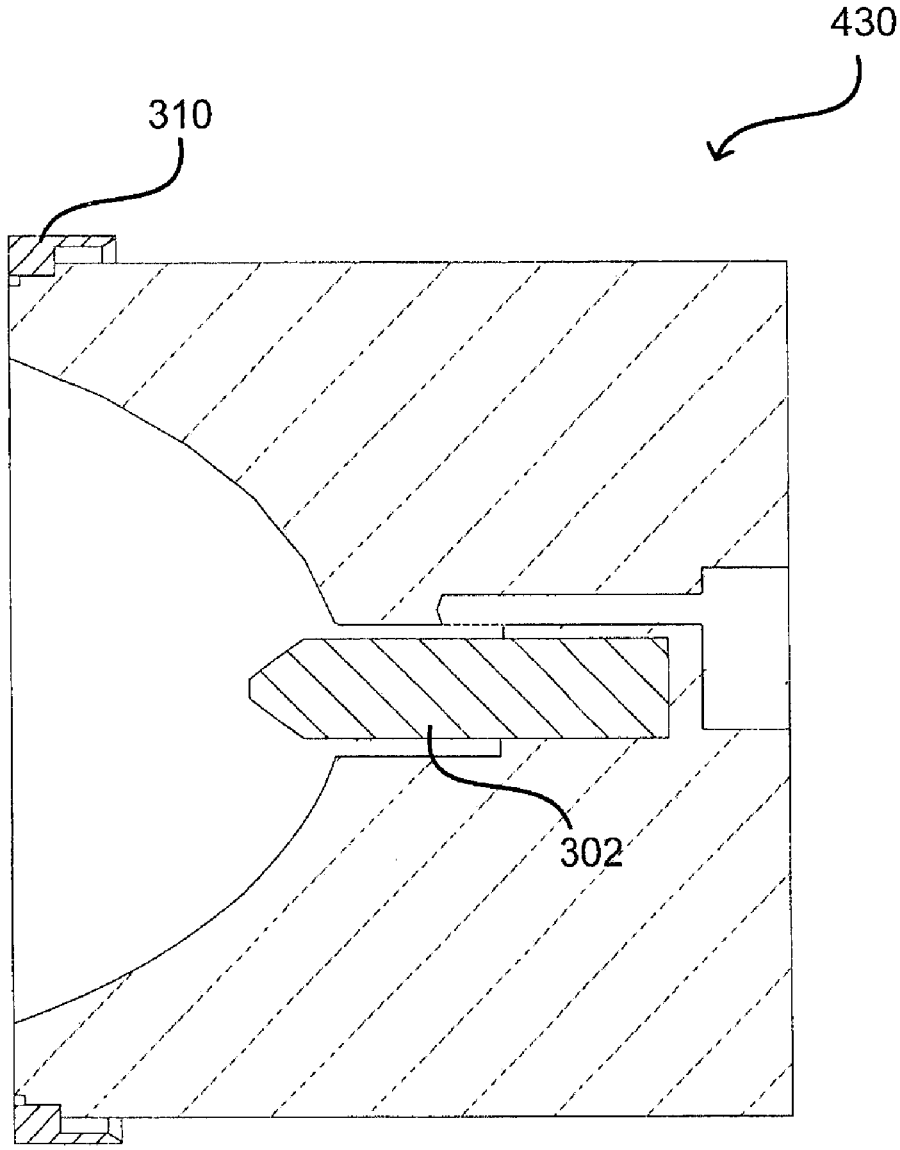
Figure 5A:
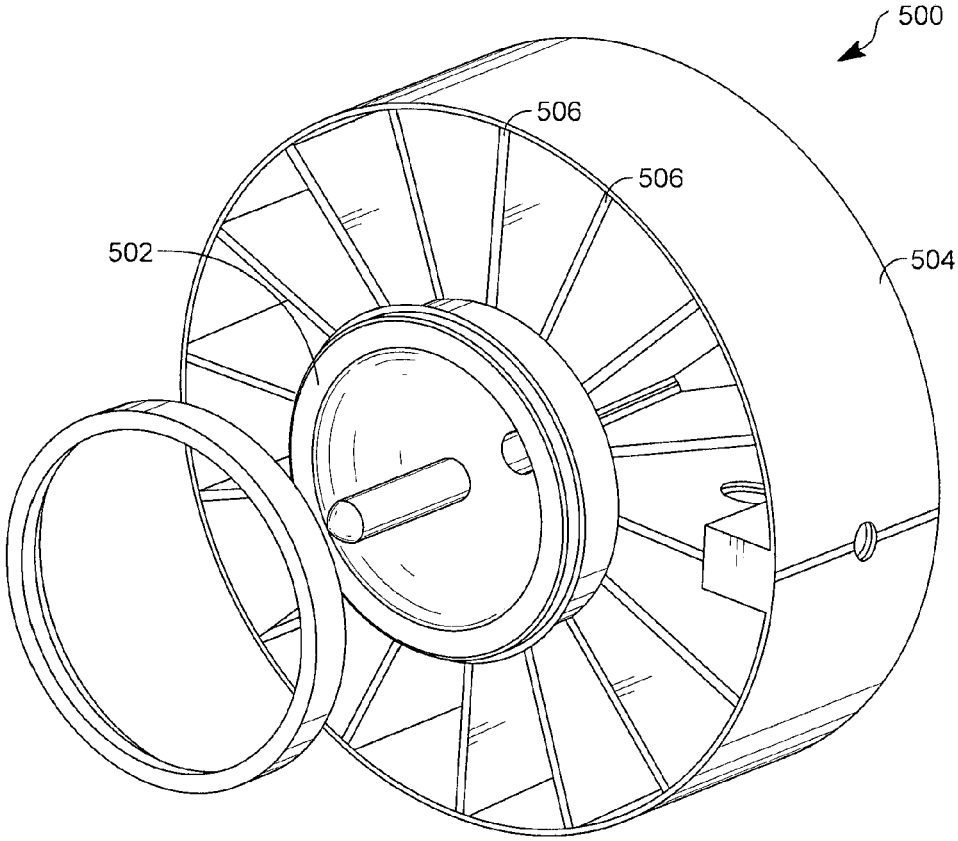
FIGS. 5(*a*)-5(*f*) show different views of back assemblies having an integrated heat sink in accordance with one embodiment of the present invention.
Figure 5B:
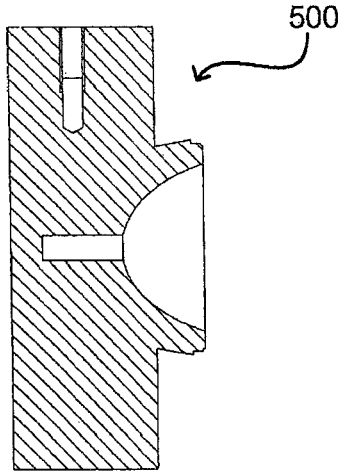
Figure 5C:
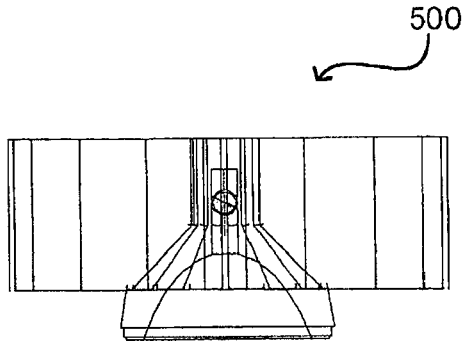
Figure 5D:
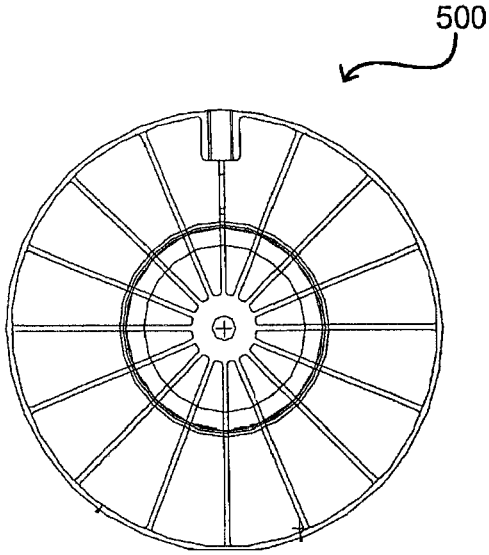
Figure 5E:
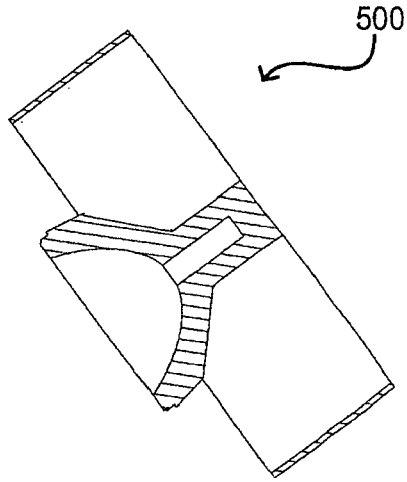
Figure 5F:
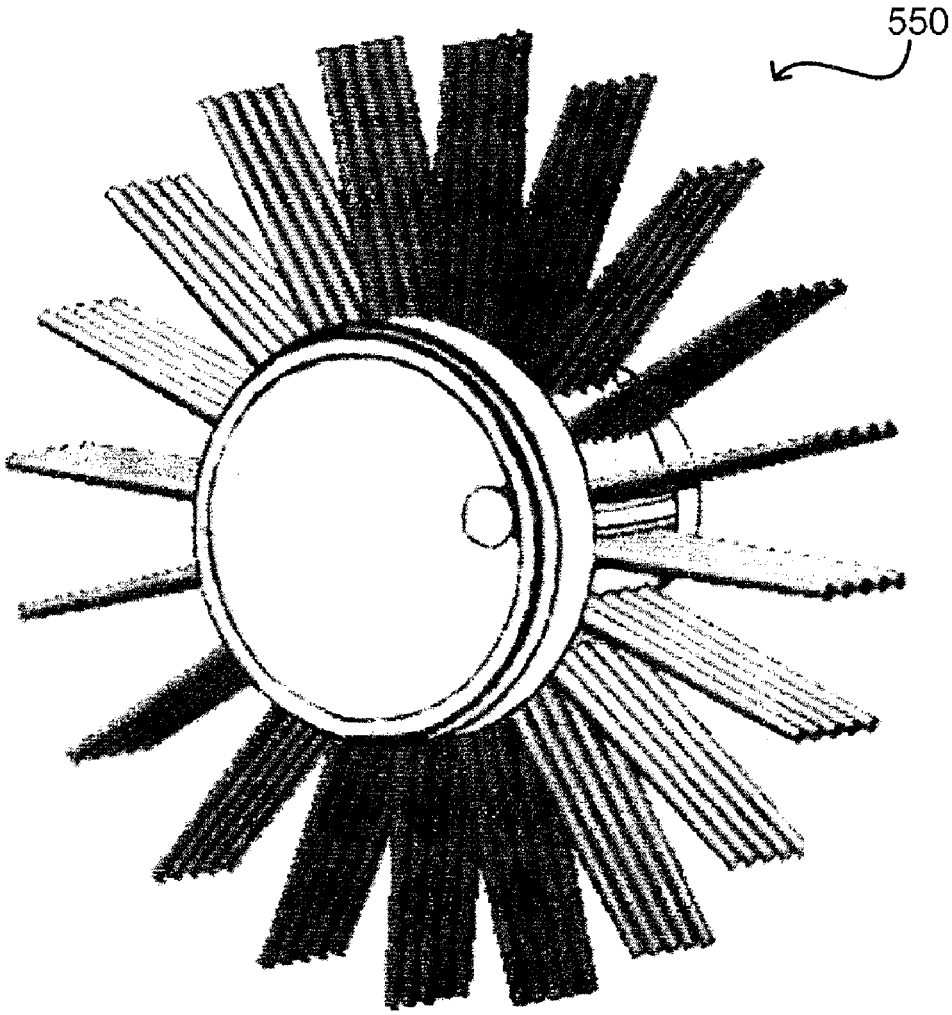

A back assembly 400 in accordance with another embodiment is shown in FIG. 4(*a*). In this assembly, an anode 402 again can be brazed into a blind hole contained in a cooling cylinder 408 of a metal body 404. Once the anode is attached, a drop-in reflector 414 can be maneuvered into the reflector cavity 406 of the metal body. The drop-in reflector can be any appropriate reflector, such as a reflector consisting of a substrate such as electroformed nickel, aluminum, ceramic, quartz, or glass, and a reflective film coating such as silver or a dichroic multilayer film. The reflector 414 can be formed using any appropriate mechanism known in the art, such as machining or molding. The drop-in reflector 414 can have a central opening or aperture (not shown) that is slightly larger than the circumference of the anode 402, such that the anode can help to position the reflector 414 as the reflector is being moved into the cavity 406. The drop-in reflector also can have a circumferential ridge 418 that is shaped to mate with a reflector step 416 formed in the first end of the metal body 408. The circumferential ridge 418 allows the drop-in reflector to be self-aligning, and maintains the precise position of the reflector relative to the anode and cathode. The alignment can be important, as a slight misalignment of the reflector of even $^{5}/_{10,000}$" can cause overheating due to a reduced amount of heat transfer. In one embodiment, the drop-in reflector has approximate dimensions of 1.2 inches in diameter (tapering to 0.6 inches in diameter) and 0.7 inches in length, with a circumferential ridge on the large diameter and a central aperture of approximately 0.3 inches in diameter. The cavity of the metal body can be formed to have substantially no spacing between the cavity and the drop-in reflector 414, in order to provide good thermal contact. An advantage to such a configuration is that the reflector does not need to be brazed into the metal body, but can be held in place by the self-aligning features and the front assembly as described below. In some embodiments utilizing a drop in reflector, the reflector can be brazed to the metal body to allow for better thermal contact, as well as to allow for inverted handling of the subassembly. In one embodiment, the weld ring 410 has an inner lip feature (not shown) that can hold the reflector 414 against the metal body when the weld ring is brazed in place.

The metal body component of the back subassemblies, such as component 304 in FIG. 3 and component 404 in FIG. 4(*a*), can have additional features incorporated to improve manufacturability and/or performance. FIG. 4(*b*) shows an alternate embodiment of such a metal body component 420, wherein grooves 422 are added to the exterior of the metal body. The inclusion of these grooves can reduce the overall weight of the component, as well as the amount of material required when manufactured using a MIM process, such that the cost of the component can be reduced. The grooves 422 also function to increase the surface area of the component 420, thereby improving the dissipation of heat generated by the arc.

In either of the embodiments shown in FIGS. 3(*a*)-(*b*) and 4(*a*)-(*b*), the cooling cylinder of the metal body can be shaped to receive a heat sink for removing heat from the lamp assembly. While short arc lamps can be designed to operate at high power, sufficient heat removal can be needed to compensate for the increased power level operation. An arc lamp operating with a xenon atmosphere can reach temperatures on the order of 200° Celsius, such that a sufficient amount of heat must be removed to prevent premature erosion of the electrodes and/or failure of the braze seals. If a heat sink is not used, or if the lamp is to be brought into contact with a separate heat sink of mechanism for heat removal, the cooling cylinder may not exist or can be of approximately the same dimension as the metal body, such as is shown in the embodiment of FIG. 4(*c*). In this embodiment the back of the metal body 430 can be substantially flat, with an exemplary body having dimensions of about 1.6 inches in diameter. This design allows the heat sink to be part of the device into which the lamp is placed, such as a projector, and would not require a heat sink to be attached to the lamp itself. This approach allows for easier replacement of the lamp and lowers the cost of each lamp. In addition, a standard heat sink can be attached to this cylindrical body. In this case the diameter of the hole in the heat sink can be designed to accept the full diameter of the body 430, rather then the smaller diameter of the cooling cylinder 316.

FIGS. 5(*a*)-(*e*) show differing views of a back assembly 500 in accordance with another embodiment, wherein a heat sink 504 is integrated with the metal body 502. This configuration eliminates the thermal barrier that exists at the interface between separate metal body and heat sink assemblies, thus providing more efficient cooling. The position of the heat sink about the metal body allows for heat transfer from the metal body. As the anode typically is the hot spot in the lamp and requires sufficient thermal transfer, the anode can be mounted directly to the metal body to act as a heat-conductive mounting. The fins 506 of the heat sink 504 also can be a part of the metal body of the back assembly. Methods for forming a heat sink are well known and will not be discussed in detail herein. The heat sink can be made of any appropriate material and of any appropriate design providing sufficient heat removal. FIG. 5(*f*) shows a view of a lamp body 550 with a back assembly having a plurality of integrated heat sinks in accordance with another embodiment.

Figure 6A:
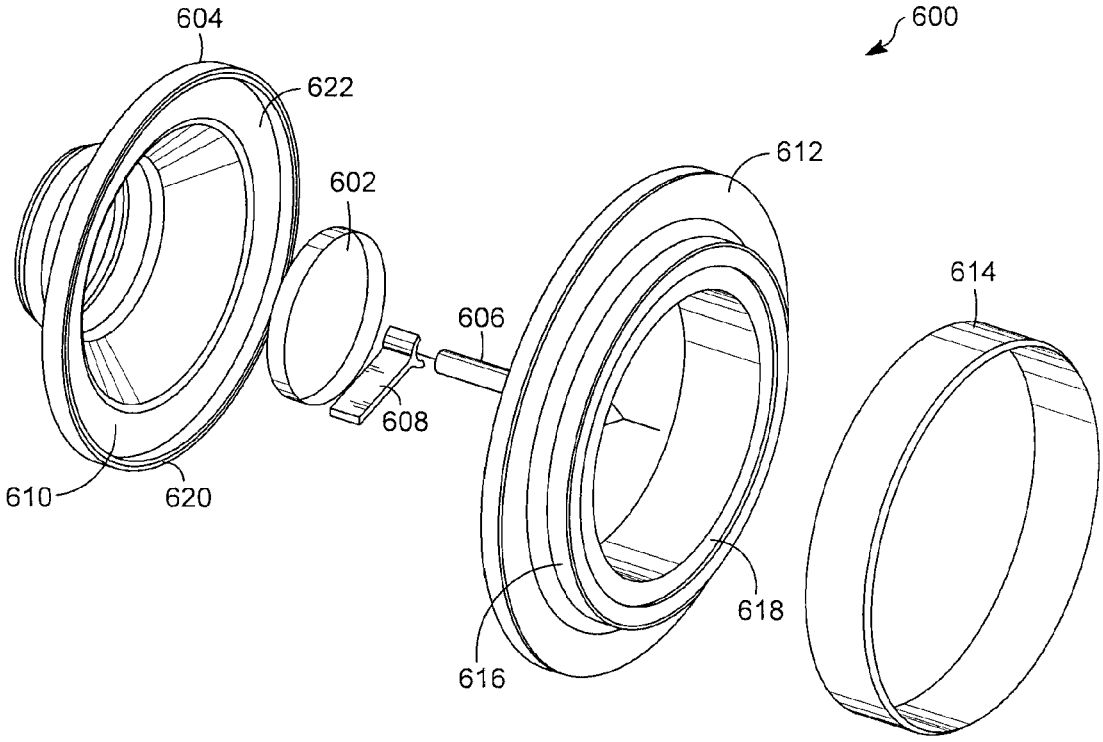
FIG. 6(*a*) is an exploded view diagram of a front assembly of an arc lamp in accordance with one embodiment of the present invention.
Figure 6B:
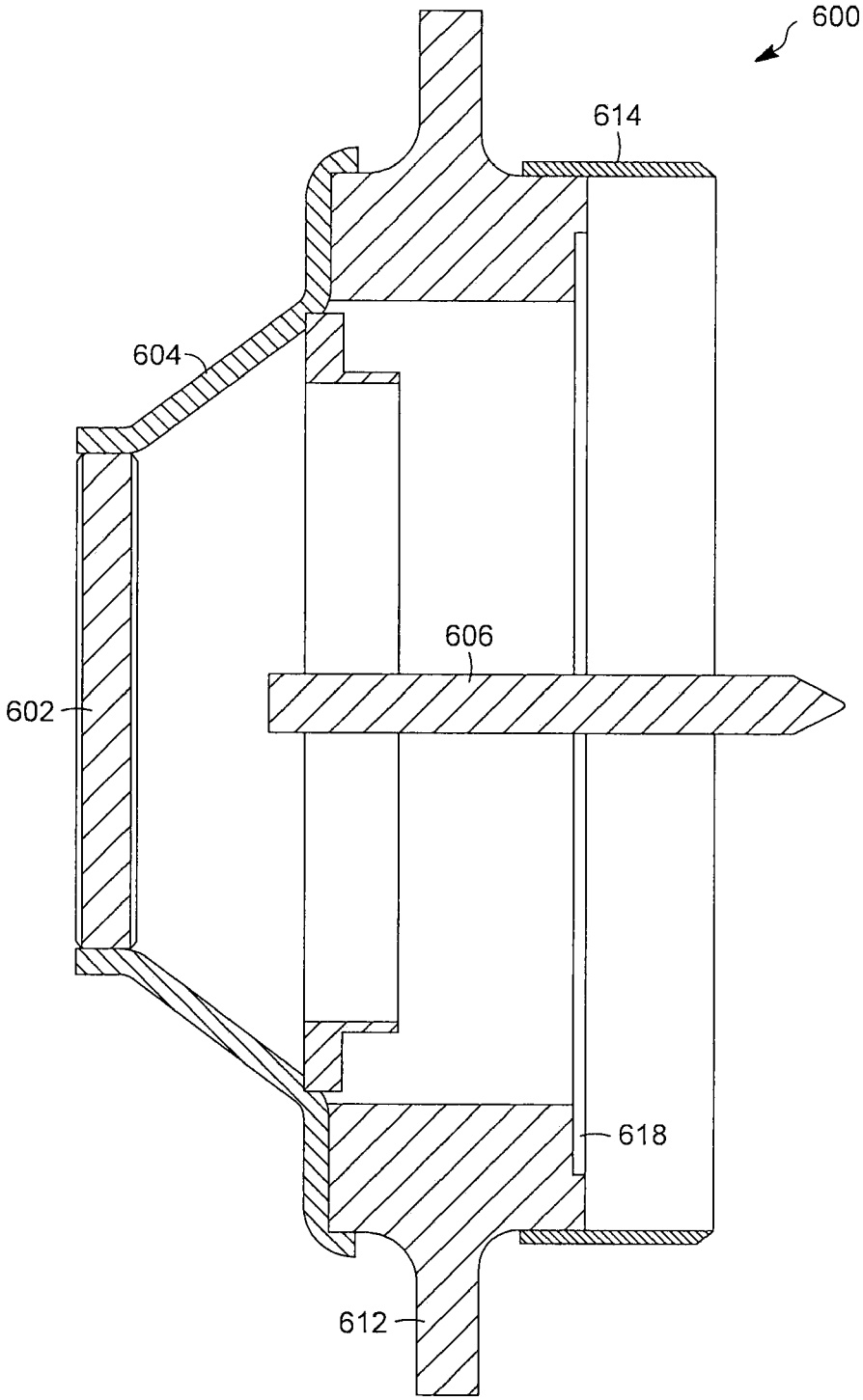

For each back subassembly described with respect to FIGS. 3-5, it is necessary to provide a complimentary front subassembly. One such front assembly 600 is shown in the embodiment of FIG. 6(*a*). In this assembly, a sleeve member 604 is used to seal the lamp interior including a mount for a light-transmitting window 602. The sleeve can be made of any appropriate material, such as a tungsten-copper composite or Kovar®, and can be formed from any appropriate process such as a MIM, machining, or drawing process. Kovar®, a registered trademark of Westinghouse Electric Corporation, is a nickel-iron-cobalt controlled-expansion alloy containing 29% nickel. The coefficient of expansion of such an alloy, which decreases with rising temperature to the inflection point, can match the expansion rate of materials such as ceramics. These alloys often are used for glass-to-metal seals in applications requiring high reliability or resistance to thermal shock. Examples include high-power transmitting valves, transistor leads and headers, integrated circuit lead frames, and photography flash bulbs.

The dimensions of an exemplary sleeve are on the order of about 1.6 inches in diameter (tapering to about 0.8 inches) and about 0.25 inches in length. As discussed above, the window can be made of any appropriate material capable of transmitting light and surviving at the high operating temperatures, such as sapphire, which also is capable of being joined to the sleeve material by a process such as brazing. A sapphire window can be coated, such as with a dichroic coating to reflect and/or absorb certain bandwidths of light. The sleeve on the front assembly also can provide support and positioning for a cathode 606 of the lamp. The cathode can be any appropriate material, such as is described with respect to the anode above. The positioning of the cathode can be controlled through use of a single strut 608. The strut 608 can have a shape at a receiving end for at least partially surrounding an end of the cathode 606. The cathode can be attached to the strut by any appropriate mechanism, such as by brazing. The single strut 608 can be received by a slot 610 in the sleeve 604, such that a precise positioning of the strut and cathode can be obtained. The strut 608 can be made with a stop or a notch to control the axial position of the cathode 606 with respect to the anode of the back assembly, in order to ensure a proper arc gap distance between the electrodes. The sleeve also can have an additional number of struts extending to support the cathode. Each of the struts can extend to approximately a central axis of the sleeve in one embodiment, forming a half-bar strut that only connects to the sleeve at a single location.

The sleeve 604 can have a circumferential lip 620 that can self-align the sleeve with respect to an insulating spacer 612. An insulating spacer typically is used to electrically isolate the anode and the cathode as known in the art, and can be formed from a ceramic material such as aluminum oxide. The insulating spacer can have a cylindrical step, or an outer diameter, that is designed to be received by the circumferential lip 620 of the sleeve 604, such that the insulating spacer and sleeve are maintained in a desired orientation with respect to each other. An exemplary spacer can be about 2.2 inches in diameter. The spacer and sleeve can be joined by any appropriate means, such as by brazing the cylindrical step of the spacer 612 to the circumferential lip 620 of the sleeve 604, or by face brazing the flat region 622 of the sleeve 604 to a mating flat region (not shown) on the spacer. The insulating spacer 612 also can have another cylindrical step 616 positioned on the side opposite the sleeve 604. This step 616 can be shaped to receive a weld ring 614, such as a nickel-iron-cobalt controlled-expansion alloy weld ring described with respect to FIGS. 3-5. The step further can be shaped to self-align the spacer and the weld ring. The weld ring 614 can be brazed to the step 616 of the insulating spacer 612. This front assembly weld ring 614 also can be shaped to be mated with the weld ring of the back assembly. The front weld ring can fit concentrically inside or outside the back weld ring, but should be of sufficient dimension to allow the front and back assemblies to easily be mated together, and self-aligned, while providing a tight enough fit that the front and back assemblies can be attached and sealed by welding the front and back weld rings.

The sleeve 604 also can be shaped to receive a second heat sink (not shown) that can be brought into contact with the front assembly in order to remove heat from the area near the window-sleeve and sleeve-insulator interfaces, thus reducing the stress in these joints. The reduction in stress can lower the likelihood of a joint failure during operation at the expected high powers.

The insulating spacer also can have a circular recess 618 shaped to receive the circumferential ridge 418 of a drop-in reflector described with respect to FIG. 4. The recess 618 can be shaped to self-align the spacer 612 (and front assembly) with the drop-in reflector (and back assembly), as well as to hold the drop-in reflector tightly in place against the cavity of the back assembly. If the back assembly does not use a drop-in reflector, as in FIG. 3(*a*), the insulating spacer would not need the circular recess 618. FIG. 6(*b*) shows a cross-section of the assembled front assembly.

Figure 7A:
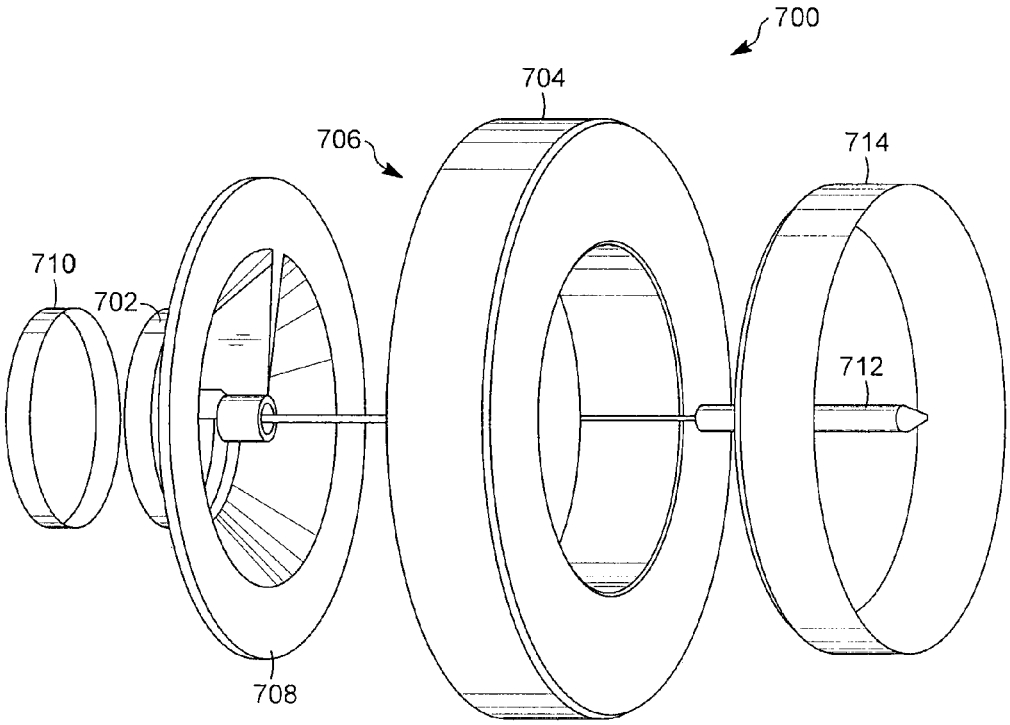
FIG. 7 is (a) an exploded view diagram and (b) a cross-section diagram of another front assembly of an arc lamp in accordance with one embodiment of the present invention.
Figure 7B:
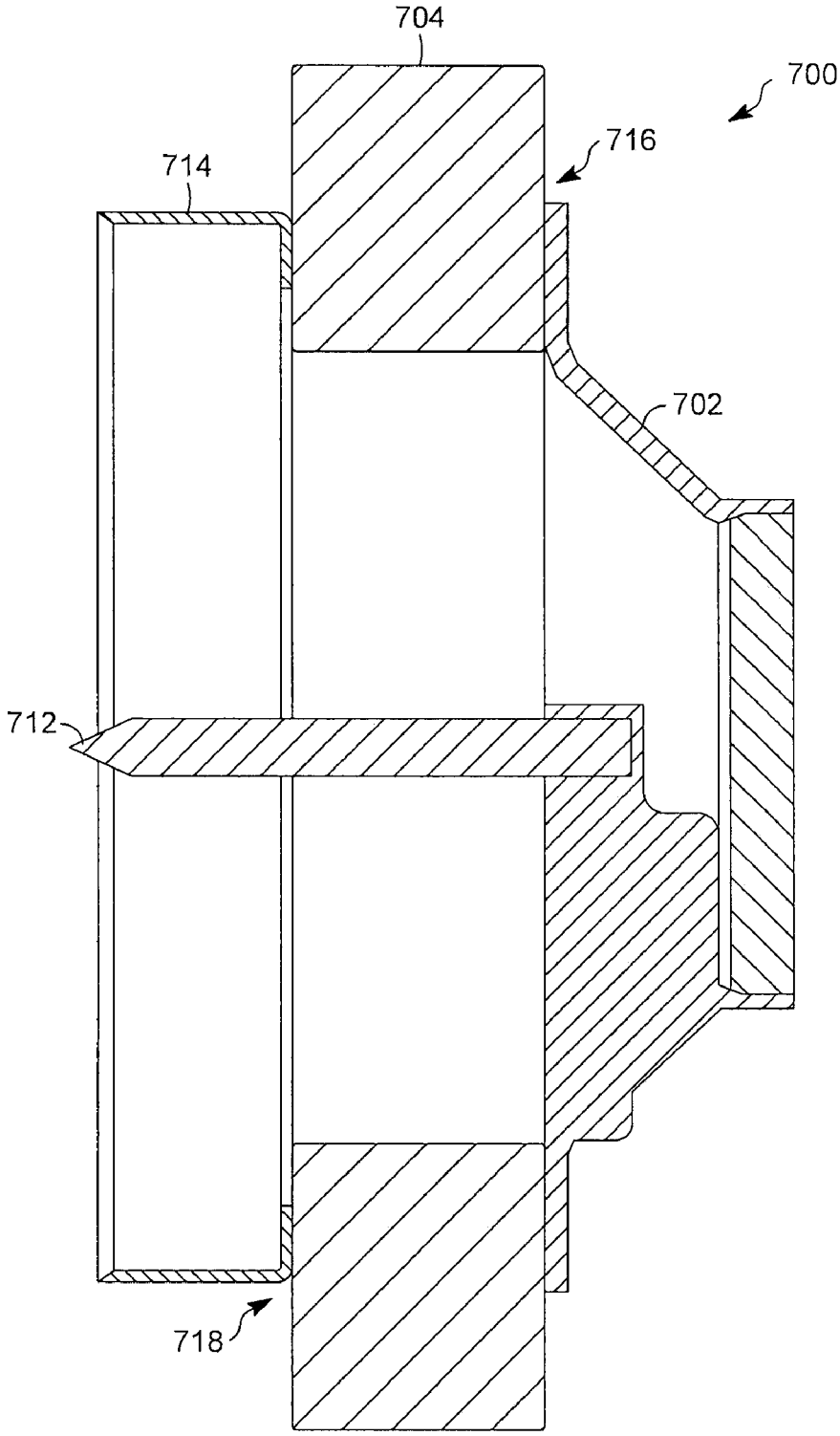

FIG. 7(*a*) shows an exploded perspective view, and FIG. 7(*b*) a corresponding cross-sectional view, of a front assembly 700 in accordance with another embodiment of the present invention. In this embodiment the strut is integrated into the sleeve 702, such as is shown in more detail in FIG. 12, which also includes a mount for the window 710 and an alignment hole to position the cathode 712. This sleeve does not have a circumferential lip, but instead has a flat face 708 that can be brought into contact with an opposing flat face 706 of the insulating spacer 704. A face braze or other appropriate connection mechanism can be used to attach the sleeve and the spacer, such as by forming a face seal 716 between the sleeve and the spacer. A face braze also can be used to connect the spacer 704 to the weld ring 714, forming another face seal 718. This assembly has an advantage over the assembly of FIG. 6 in that the machining of the sleeve and/or insulating spacer is less complex, and thus less costly, but has the disadvantage that the sleeve and spacer are not self-aligning. The sleeve 702 also can be shaped to receive a second heat sink (not shown) that can be brought in contact with the front assembly in order to remove heat from the area near the window-sleeve and sleeve-insulator interfaces, thus reducing the stress in these joints. The reduction in stress can lower the likelihood of a joint failure during operation at the expected high powers.

The arrangement shown in FIG. 7 can be brazed in the normal fashion whereby the ceramic is metalized and a braze alloy is placed between the parts to be joined and then brought to a sufficiently high temperature to melt the braze, which results in joined parts when cooled. Alternately, this face joint arrangement is well suited for active metal brazing in which the ceramic does not have to be metalized. Rather, the active brazing alloy contains additional metallic components that effectively metalize the insulator surface when the assembly is brought up to the braze temperature. The braze component then joins the parts as before, but a process step has been eliminated thus reducing scrap and cost. Yet another method that is well suited for brazing this arrangement is diffusion welding. In this process there is no required metalization of the insulator or braze alloy. Instead, the parts to be joined are squeezed together with a compressive pressure that is on the order of 10 MPa, and held at a temperature that is approximately 70% of the melting temperature of the metal component. Under these conditions the metal moves into the voids at the interface between the insulator and metal part, and when filled the two parts are tightly bonded. Active metal brazing and diffusion welding are more difficult to implement on cylindrical seals such as that between 612 and 614.

Figure 8:
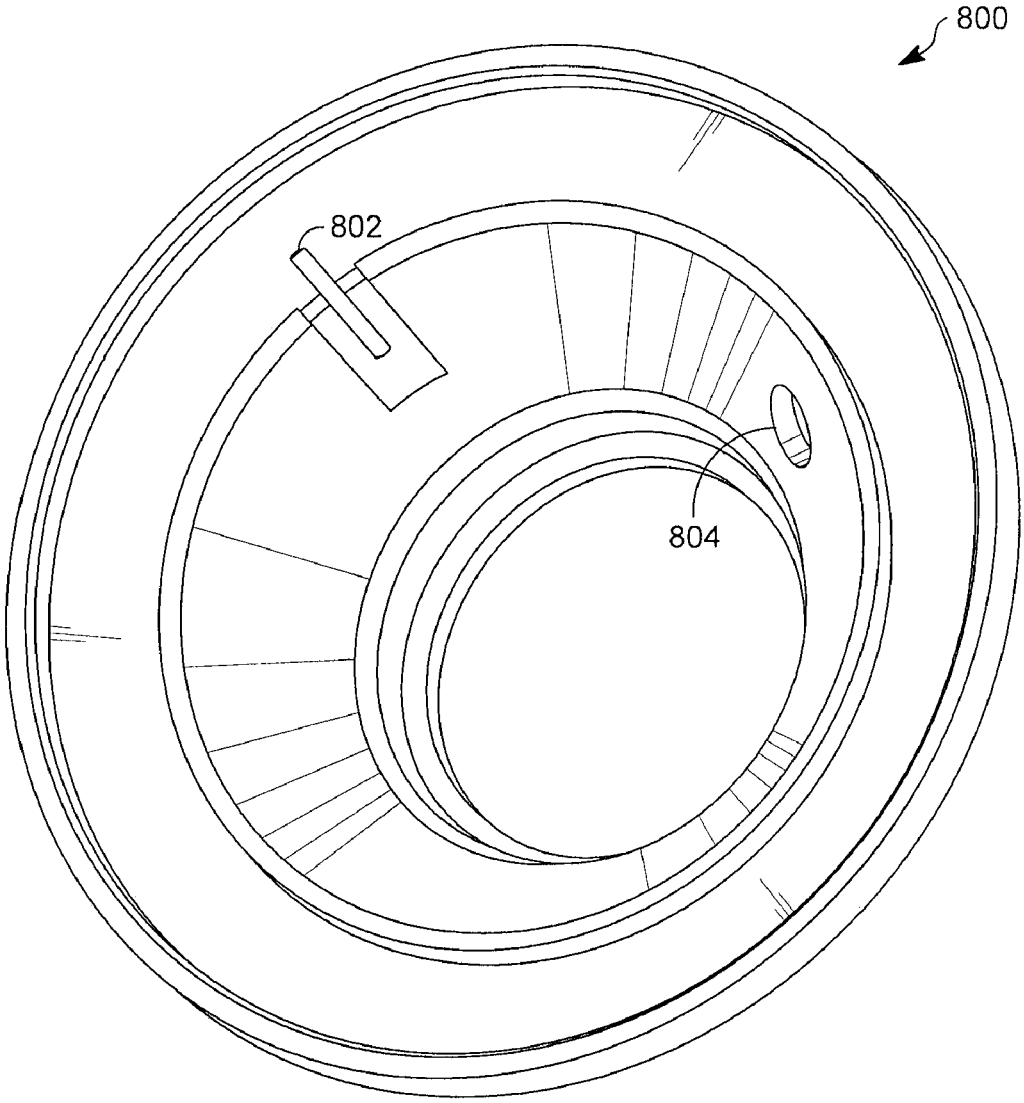
FIG. 8 is a diagram of a sleeve having a single strut slot in accordance with one embodiment of the present invention.
Figure 9:
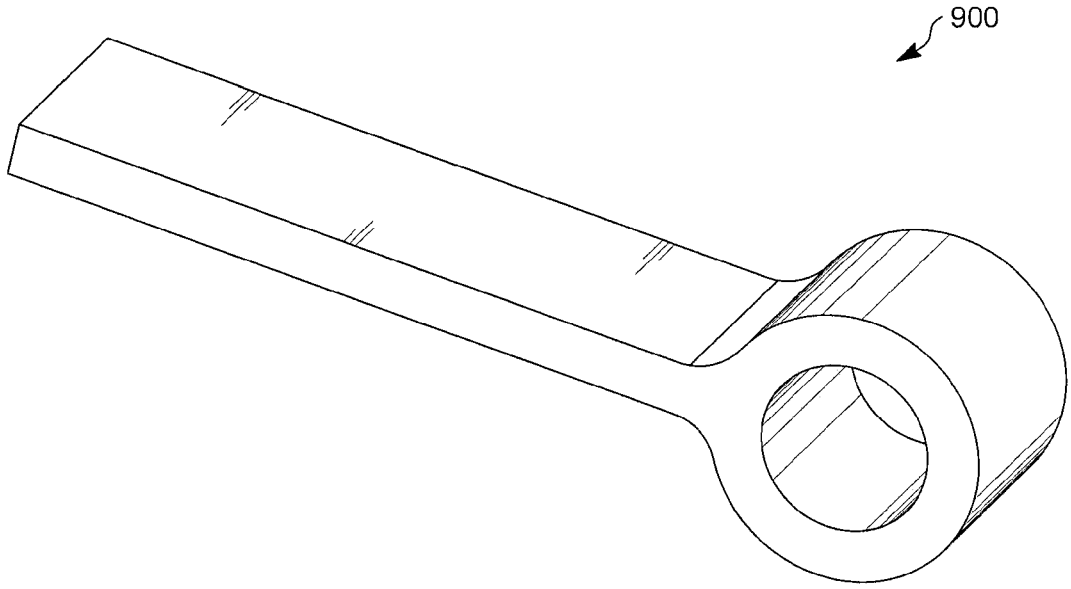
FIG. 9 is a diagram of a single strut piece in accordance with one embodiment of the present invention.

FIG. 8 shows a perspective view of a sleeve 800 such as that shown in FIG. 6. The slot 802 for receiving the single strut can be seen, as well as a gas opening 804. The gas opening 804 can receive a xenon-fill tubulation (not shown), which can be made of copper tubing, for injecting xenon gas into the lamp after final assembly and brazing. The slot can be shaped to receive a single strut, such as the exemplary strut 900 shown in FIG. 9. Using a slot to receive, self-align, and hold the single cathode strut does away with the positioning ring that was required in previous embodiments for positioning the cathode. Further, the use of a single strut reduces the blockage of light reflected through the window. The single strut can be a molded piece, such as a piece produce by a MIM process. The strut then can be simply welded or brazed into the slot in the shell. In one example, the strut has dimensions of about 0.6 inches in length by about 0.2 inches in width, with a thickness on the order of 0.03 inches. This design provides jigging of the cathode for concentricity, and with a stop or notch as discussed above can automatically jig the axial depth of the cathode.

Figure 10:
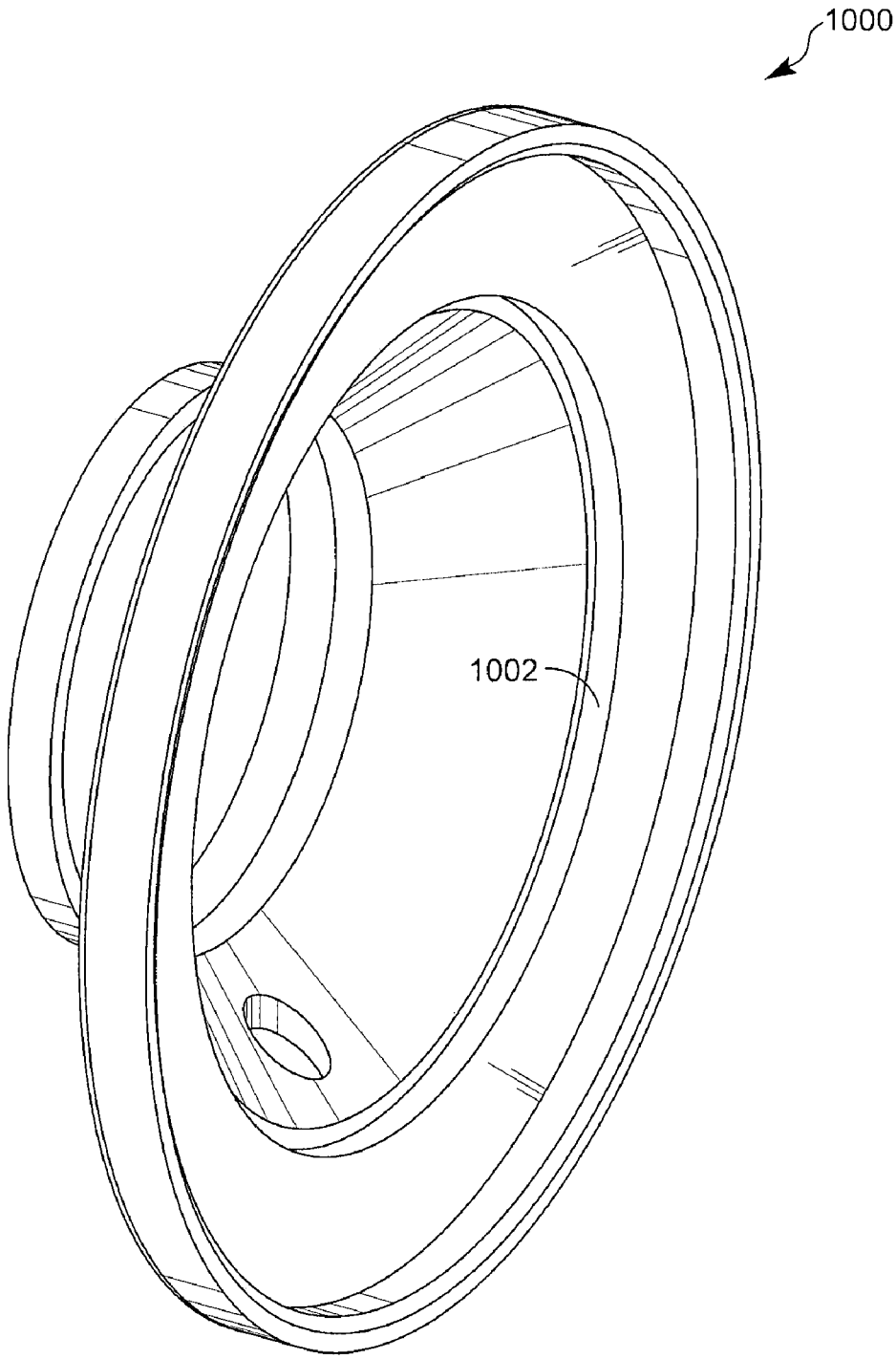
FIG. 10 is a diagram of another sleeve in accordance with one embodiment of the present invention.
Figure 11A:
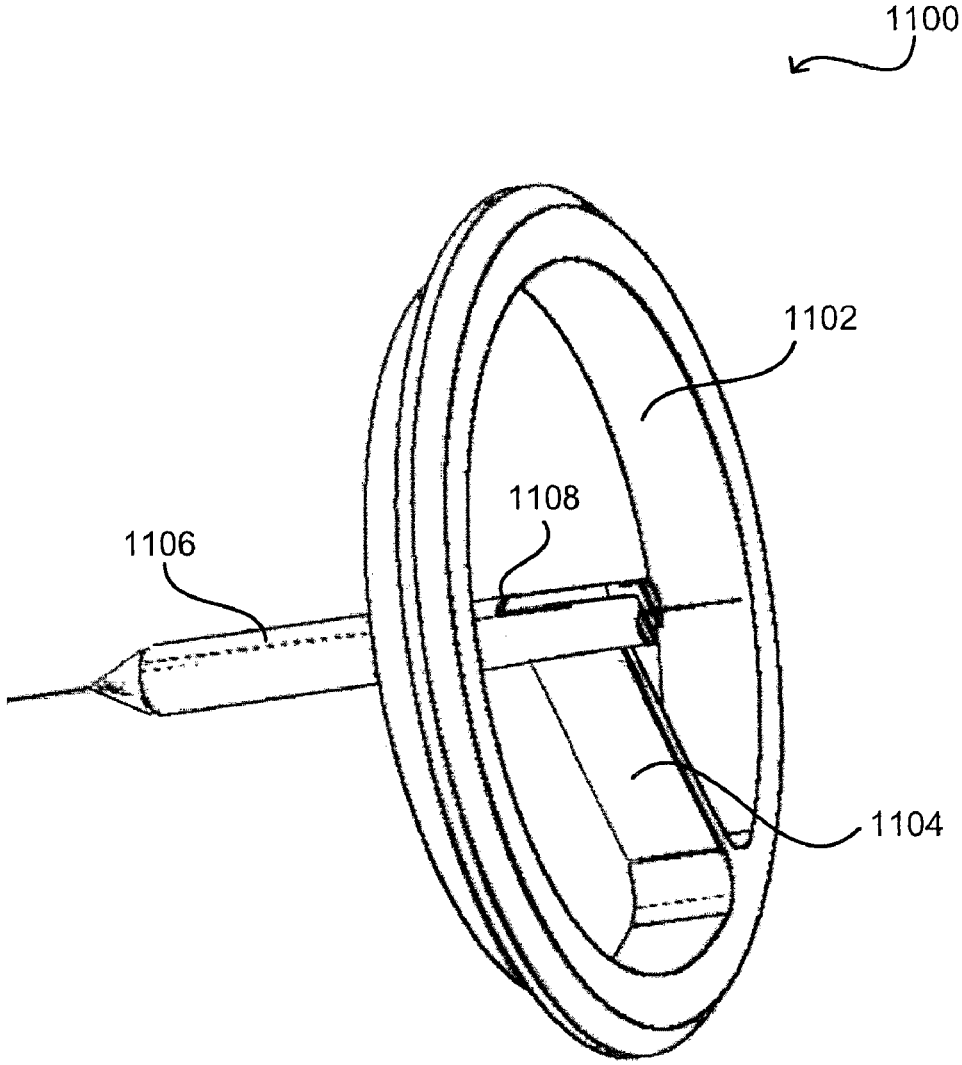
FIGS. 11(*a*)-(*b*) are diagrams of strut ring assemblies that can mate with the sleeve of FIG. 10.
Figure 11B:
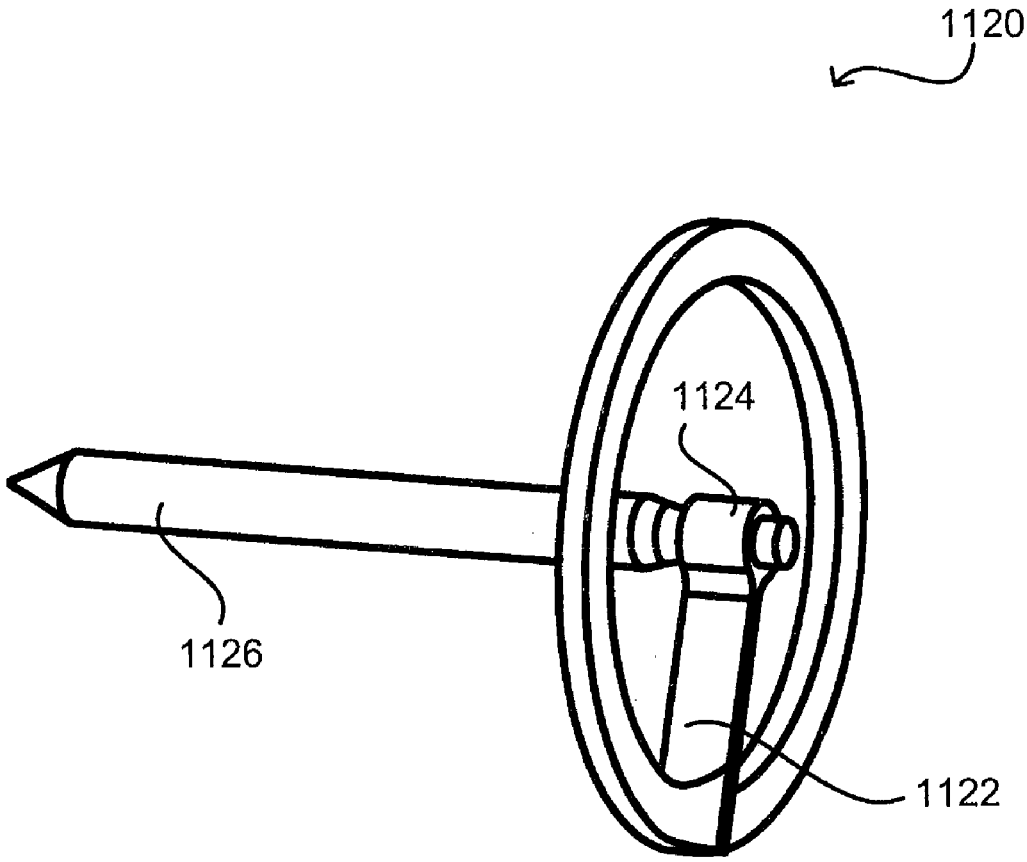

An alternative embodiment is shown in FIGS. 10 and 11. In this embodiment, the sleeve 1000 does not contain a strut aligning notch, but instead has a ring shelf 1002 for receiving and self-aligning a strut ring such as is shown in FIGS. 11(*a*) and (*b*). Such a strut ring can be welded or brazed to the ring shelf 1002 of the sleeve 1000. The strut ring 1102 can be a single machined or molded piece, such as is shown in the assembly 1100 of FIG. 11(*a*), which includes a single strut 1104 for positioning the cathode 1106. In this embodiment, the strut is shown to be a substantially flat piece, which is received in a notch 1108 of the cathode 1106. The notch can provide for both axial and radial self-alignment of the cathode 1106 with respect to the sleeve 1000. FIG. 11(*b*) shows an assembly 1120 in accordance with another embodiment, in which the strut 1122 is similar to that shown in FIG. 9. The ring 1124 at the end of the strut 1122 is used to center the cathode 1126. The axial position of the cathode can be set in one embodiment by having the ring 1124 configured instead as a blind hole, which provides a stop for the cathode. When using a strut ring, it is possible to use additional struts, such as an additional one or two struts positioned about the ring.

Figure 12:
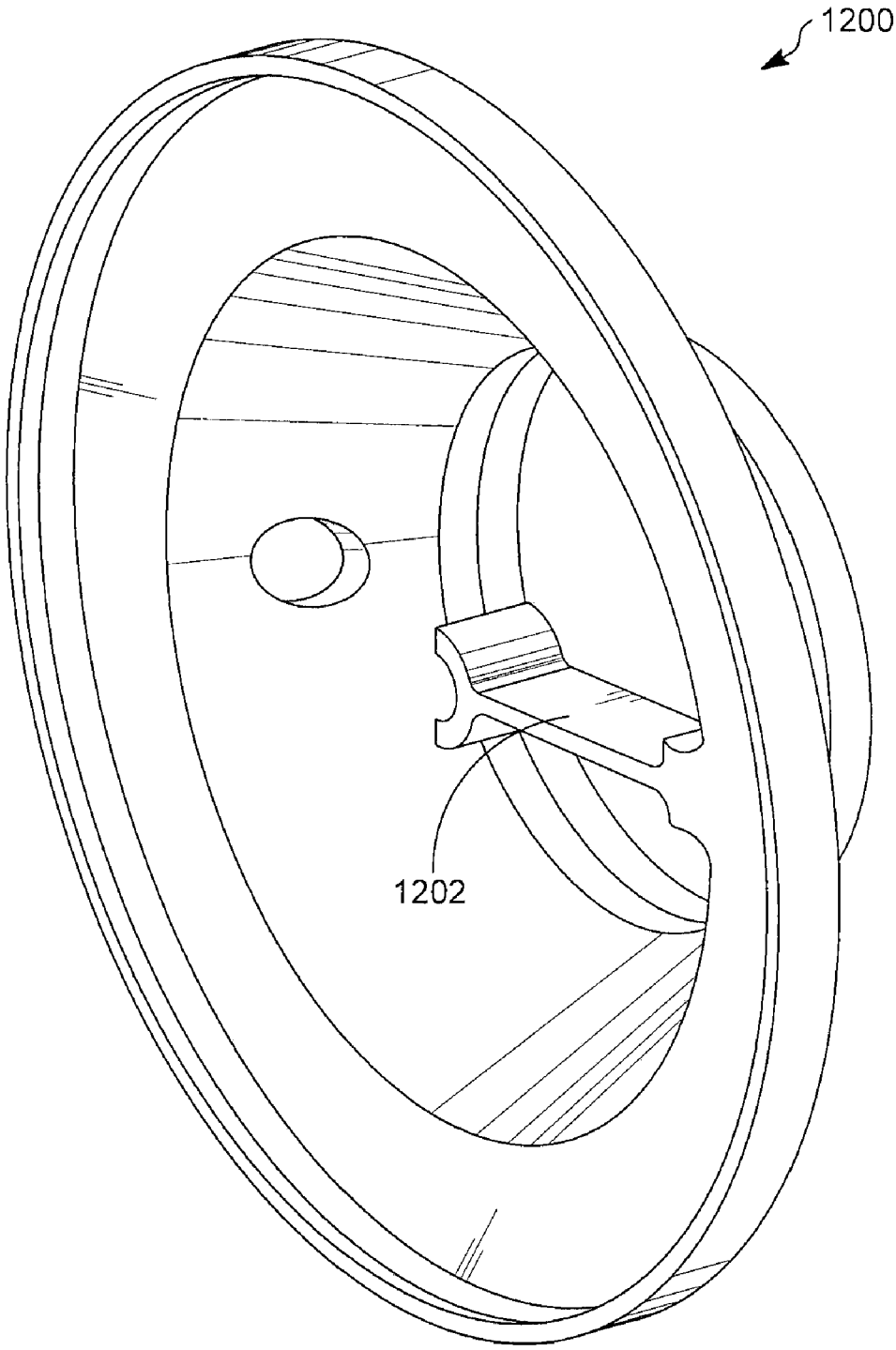
FIG. 12 is a diagram of a sleeve with an integrated strut in accordance with one embodiment of the present invention.

FIG. 12 shows yet another embodiment, in which the strut 1202 is formed as part of the sleeve 1200, such that no assembly or separate pieces are needed, and the relative position of the strut and sleeve is ensured. In order for the shell and strut to be a single piece, it can be necessary to use an acceptable material to get the proper amount of heat tolerance and heat transfer, such as a composite of tungsten and copper. The use of a tungsten-copper composite can provide for significantly improved heat removal from the cathode, as the thermal conductivity of such a material can be approximately ten times higher than that for Kovar. Heat sink fins also can be integrated with this assembly in a molding or brazing process, thus eliminating the thermal barrier present with separate assemblies. It also can be necessary to use an appropriate process to form the integrated strut, such as a MIM process.

Figure 13A:
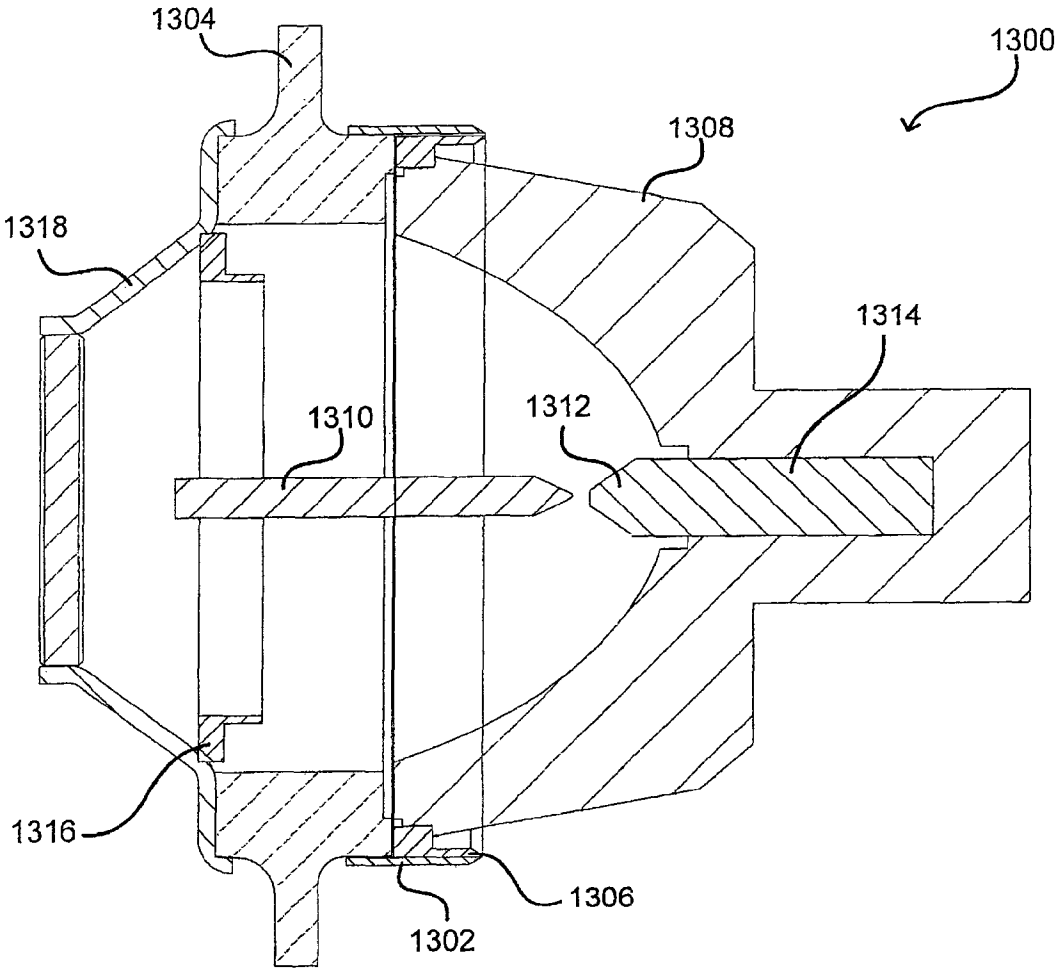
FIG. 13(*a*) is a cross-section diagram showing assembled front and back assemblies in accordance with one embodiment of the present invention.
Figure 13B:
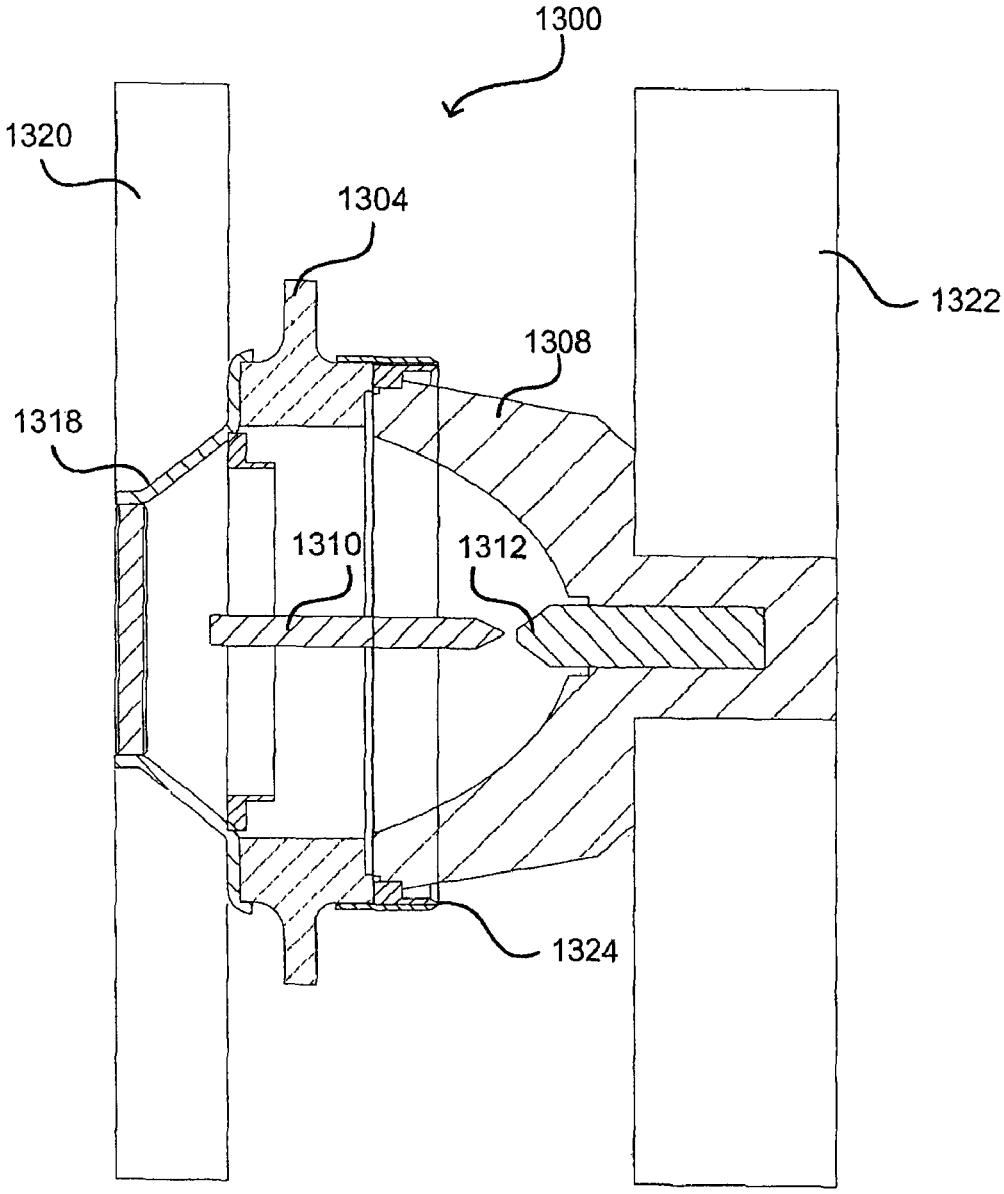

Once the front and back subassemblies are finished, the subassemblies can be mated and connected by a process such as TIG welding to form a lamp assembly 1300 as shown in the embodiment of FIG. 13(*a*). Here, it can be seen that the front weld ring 1302, which is brazed to the insulating spacer 1304, fits over the rear weld ring 1306, which is brazed to the metal base 1308. The lamp then can be sealed by simply welding the adjoining edges 1306 of the concentrically-aligned front and rear weld rings. These dual weld rings not only help to ensure alignment of the front and back assemblies, but the rings allow the lamp to be sealed by a standard welding process, since a weld ring such as a Kovar® ring could not be welded to the copper base. Once the lamp is assembled, the cathode 1310 and anode 1312 should be substantially axially aligned with an appropriate arc gap dimension, as assured by the blind hole 1314 and strut ring 1316 as aligned by the sleeve 1318. As discussed above, and as shown in FIG. 13(*b*), a rear heat sink 1322 can be connected to the back assembly of the lamp via the cooling cylinder, or can be formed as part of the metal base 1308. In addition, a front heat sink 1320 can be connected to the front assembly of the lamp via the metal sleeve 1318, or can be formed as part of the metal sleeve.

In order to operate the lamp, it can be desirable to supply a separate trigger electrode capable of applying a trigger voltage to spark the xenon gas. The use of a trigger electrode can provide for a lower cost ignition system, as the ignition transformer does not need carry a high DC lamp current during operation. Further, a trigger electrode can provide for lower power losses (such as resistive losses) in the ignition transformer, which often are in the 2-5% range. The gap between trigger electrode and cathode (or anode) can be smaller than the arc gap between the anode and cathode, allowing for a lower ignition voltage requirement. This lower ignition voltage requirement can ease the design of the ignition system, and can provide an extra safety factor as less isolation is required in the wiring system between the igniter and the lamp assembly. A lower ignition voltage and a smaller ignition transformer allow for faster and easier repeated/pulsed ignition of the lamp, as there is less energy stored in the discharge capacitors. The trigger electrode can be formed of any appropriate material and design, and can utilize a separate power supply (not shown) if needed. The trigger electrode can be used to supply a spark on the order of 5 kV-40 kV in order to ignite the plasma, although a voltage on the order of 20 kV to 30 kV can be more common in present lamps. Trigger electrodes are known in the art and will not be discussed in detail herein. It can be necessary, however, to design the trigger electrode in such a way that the plasma can be ignited but arcing between the electrodes at the trigger can be prevented.

Due to the metal body construction, various lamp embodiments described herein can provide a unique means of controlling the power delivered to the lamp from a DC power supply, and thus the amount of luminous flux emitted from the lamp. A lamp will operate at a certain temperature, depending on the external cooling level (determined by the ambient air temperature and the air speed across the lamp) and the power delivered to the lamp. For a constant cooling level, the temperature of the lamp becomes a sensitive function of the lamp power. In some embodiments, the lamps exhibit a substantially linear operating voltage temperature coefficient, with the operating voltage increasing with an increase in body temperature. Since the function is linear, this effect can be used to predict the operating temperature of the lamp. It therefore is possible to build some "intelligence" into the power supply, such as to determine whether the lamp is operating within optimal conditions or whether the cooling is still adequate. This could be implemented as a safety feature to ensure adequate cooling is applied to the lamp to prevent explosions. Currently, such a determination requires extra components and logic in the system. Using the lamp itself as the temperature sensor also could save the use of a detector and the associated system cost.

Figure 14:
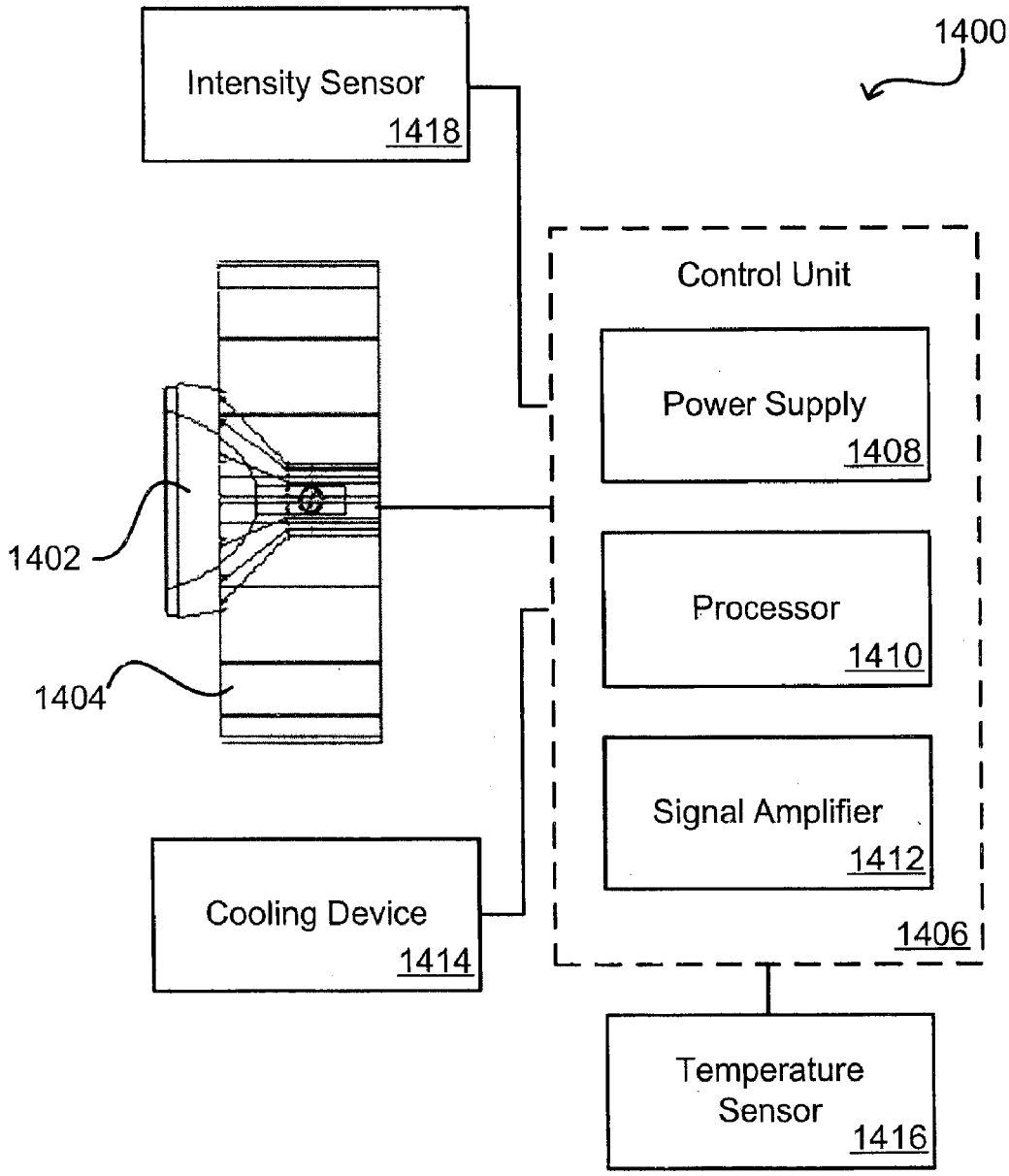
FIG. 14 is a schematic diagram which illustrates an approach wherein the temperature of the lamp can be monitored and controlled based in part on operating voltage.

A system 1400 in accordance with one embodiment wherein the lamp setup acts as a temperature sensor is shown in FIG. 14. In this system, a control unit 1406 controls the operation of the lamp 1402. For example, the control system can include (or be in electrical communication with) a power supply 1408 operable to apply a variable level of voltage to the lamp in order to control the intensity of the lamp 1402. An intensity sensor 1418 can be used to monitor the output intensity of the lamp 1402, and can send an intensity signal to a processor of the control unit 1406 to be used in adjusting the level of voltage applied to the lamp from the power supply 1408. The control unit 1406 also can control a cooling device 1414, such as a cooling fan used to direct a variable flow of air across the lamp 1402 and any heat sink 1404 used to remove heat from the lamp. A temperature sensor 1416 can be used to monitor the ambient air temperature, and can supply an ambient temperature signal to the processor 1410 of the control unit. The control unit 1406 can contain a signal amplifier 1412 or any other appropriate circuitry or elements for receiving and amplifying signals from devices such as the intensity sensor 1418 and temperature sensor 1416.

By monitoring the ambient temperature and the cooling applied by the cooling device 1414, the processor 1410 can predict the operating temperature of the lamp 1402 using the power level applied by the power supply 1408 as described above. The control unit 1406 can include a predetermined temperature threshold for the lamp 1402, such that if the predicted temperature approaches or reaches that temperature based on a change of operating voltage, the control unit can direct the cooling device 1414 to increase (or decrease) cooling of the lamp. The control unit also, or alternatively, could direct the power supply 1408 to lower the amount of power applied to the lamp, thereby reducing the operating temperature of the lamp. If the power is lowered, however, the control unit may need to use the information from the intensity sensor 1418 to ensure that the light is still outputting light with an intensity above a predetermined operating intensity level.

Similarly, the lamp operating voltage can be altered by changing the external cooling conditions. For example, the control unit 1406 can direct the cooling device 1414 to increase the amount of cooling, such as by increasing the speed of a cooling fan to increase the speed of air flowing across the lamp and/or heat sink(s). By increasing the amount of cooling, the effective operating voltage of the lamp will be decreased. This is in contrast to ceramic-based reflector lamps, in which the greater thermal insulating properties of ceramic limit the sensitivity of the lamp operating characteristics (voltage and current) to external cooling conditions. This property of metal-based reflector lamps can allow for several useful lamp control schemes when combined with an appropriately configured power supply.

It should be recognized that a number of variations of the above-identified embodiments will be obvious to one of ordinary skill in the art in view of the foregoing description. Accordingly, the invention is not to be limited by those specific embodiments and methods of the present invention shown and described herein. Rather, the scope of the invention is to be defined by the following claims and their equivalents.

What is claimed is:

1. An arc lamp, comprising:

a front assembly including a metal sleeve carrying a first electrode, said front assembly further including a ring shaped insulating spacer with the sleeve being connected to one side of the spacer, wherein the sleeve has a circumferential lip encircling a portion of the outer surface of the spacer, said front assembly further including a first weld ring connected to the other side of the insulating spacer, spaced from the metal sleeve; and a back assembly including a metal body carrying a second electrode, said metal body including a second weld ring;

wherein the first and second weld rings fit concentrically together in order to align the front and back assemblies.

2. An arc lamp according to claim 1, wherein:

the insulating spacer has a cylindrical step for aligning the first weld ring.

3. An arc lamp according to claim 1, wherein the metal body of the back assembly has a recess region for aligning the second weld ring.

4. An arc lamp according to claim 1, further comprising a weld seal bonding the first weld ring to the second weld ring.

5. An arc lamp, comprising:

a front assembly including a metal sleeve carrying a first electrode, a ring shaped insulating spacer, wherein the sleeve has a circumferential lip encircling a portion of the outer surface of the spacer, said front assembly further including a first weld ring, the first weld ring having an inner face for brazing to the insulating spacer at a location spaced from the metal sleeve, said braze ring having a first knife edge opposite the brazed inner face; and a back assembly including a metal body carrying a second electrode, and a second weld ring, the second weld ring having a lip region shaped to mate with a recess region of the metal body and a second knife edge;

wherein the second weld ring has an outer diameter selected to substantially contact an inner diameter of the first weld ring when the weld rings are fit concentrically together, the first and second knife edges forming a weld region allowing for the front and back assemblies to be sealed by a welding process.

* * * * *